US006626345B2

(12) United States Patent
Amada

(10) Patent No.: US 6,626,345 B2
(45) Date of Patent: Sep. 30, 2003

(54) MAGAZINE MECHANISM FOR NAILING MACHINE

(75) Inventor: Yoshiyuki Amada, Tokyo (JP)

(73) Assignee: Max Co., Ltd., Tokyo (JP)

( * ) Notice: Subject to any disclaimer, the term of this patent is extended or adjusted under 35 U.S.C. 154(b) by 11 days.

(21) Appl. No.: 10/295,919

(22) Filed: Nov. 18, 2002

(65) Prior Publication Data

US 2003/0066860 A1 Apr. 10, 2003

Related U.S. Application Data

(62) Division of application No. 09/518,382, filed on Mar. 3, 2000, now Pat. No. 6,499,642.

(30) Foreign Application Priority Data

| | | |
|---|---|---|
| Mar. 4, 1999 | (JP) | 11-57629 |
| Mar. 4, 1999 | (JP) | 11-57630 |
| Mar. 4, 1999 | (JP) | 11-57631 |
| May 24, 1999 | (JP) | 11-144049 |
| May 24, 1999 | (JP) | 11-144050 |

(51) Int. Cl.[7] ..... B25C 1/04
(52) U.S. Cl. ..... 227/120; 227/136
(58) Field of Search ..... 227/119, 138, 227/135, 136, 137, 120

(56) References Cited

U.S. PATENT DOCUMENTS

| | | | | |
|---|---|---|---|---|
| 3,437,249 A | | 4/1969 | Baum | 227/120 |
| 3,708,097 A | | 1/1973 | Fisher | 227/136 |
| 4,558,811 A | | 12/1985 | Klaus | 227/116 |
| 4,574,991 A | * | 3/1986 | Thorsen, Jr. | 227/120 |
| 5,038,993 A | | 8/1991 | Schafer et al. | 227/120 |
| 5,240,161 A | | 8/1993 | Kaneko | 227/109 |
| 5,269,451 A | | 12/1993 | Udagawa et al. | 227/120 |
| 5,273,200 A | | 12/1993 | Hoefler | 227/136 |
| 5,626,274 A | | 5/1997 | Shkolnikov et al. | 227/109 |

FOREIGN PATENT DOCUMENTS

| | | |
|---|---|---|
| JP | 43-10477 | 5/1968 |
| JP | 6-61706 | 8/1994 |

* cited by examiner

*Primary Examiner*—Scott A. Smith
(74) *Attorney, Agent, or Firm*—Morgan, Lewis & Bockius LLP

(57) ABSTRACT

A multiple-loading magazine mechanism for a nailing machine comprising a nail feeding passage and first and second guiding portions. The nail feeding passage is for guiding one of plural rows of connected nails to a striking mechanism of the nailing machine. The first guiding portion faces the nail feeding passage, and the first guiding portion is rotatively disposed and arranged to separate one of the rows of the connected nails from the others. A second guiding portion is for feeding the connected nails.

1 Claim, 19 Drawing Sheets

MAGAZINE MECHANISM FOR NAILING MACHINE

This is a divisional of copending application Ser. No. 09/518,382 filed on Mar. 3, 2000 now U.S. Pat. No. 6,499, 642.

BACKGROUND OF THE INVENTION

1. Field of the Invention

The present invention relates to a magazine mechanism which is provided for a nailing machine. Particularly, the present invention relates to a multiple-loading magazine mechanism accommodating plural rows of connected nails called as stick nails and connected in a straight line.

More particularly, another aspect of the present invention relates to a guide mechanism made adaptable to a magazine into which so-called stick nails in the form of a structure such that heads of a plurality of nails are caused to overlap and capable of driving even a final one of the connected nails into a nose portion.

Moreover, another aspect of the present invention relates to a mechanism for adjusting the height of a magazine for a nailing machine of a type with which a plurality of connected nails are arranged and loaded capable of adjusting the height of the magazine to correspond to the length of the shaft of each of the connected nails.

Furthermore, another aspect of the present invention also relates to a nail feeding mechanism for a multiple-loading magazine for connected nails (stick nails) structured to feed nails from a multiple-loading magazine which is capable of accommodating the connected nails from inside to the outside to a nose portion of a nailing machine.

Moreover, another aspect of the present invention relates to a mechanism for holding connected nails for a multiple-loading magazine of a nailing machine adaptable to a multiple-loading magazine capable of permitting connected nails formed by linearly connecting a plurality of nails to be loaded from inside to the outside in a multi-row manner and enabled to hold the inside connected nails such that undesired movement of the connected nails is prevented if the direction of the nailing machine is changed.

2. Description of the Related Art

A magazine of a usual nailing machine incorporates only one branched passage for accommodating a series of stick nails, causing limitations to be imposed on the number of nails which can successively be driven. Therefore, a new stick nails must be loaded whenever a series of the connected nails are consumed. This mean that the troublesome operation for loading the stick nails must be repeated when a multiplicity of nails must be driven.

Therefore, a structure has been devised in which stick nails formed into a plurality of rows are loaded into the magazine. After the stick nails in the first row has been consumed, next stick nails are successively supplied. As disclosed in JP-B-6-61706, the multiple-loading magazine mechanism of the foregoing type incorporates a separating member called a moving shuttle disposed between a first stick nail and a second stick nail. The moving shuttle is moved in the lengthwise direction to sequentially separate one of the plural nail rows. Another structure has been disclosed in JP-B-43-10477 in which a plurality of stick nail passages formed in parallel with one another are formed in the magazine. Thus, the magazine is laterally slid whenever one stick nail row is consumed to cause a new row to face the nose portion.

The conventional method, however, requires the mechanism for moving the separating member and the mechanism for moving the magazine. Therefore, there arises a problem in that the overall structure becomes too complicated and the weight of the nailing machine is enlarged excessively.

As another point of view of a feeding mechanism for a magazine for connected nails, a method using a pusher, which is usually employed, is considered. The method is arranged such that a pusher is disposed in a nail feeding passage in the magazine. Moreover, the rear end of the connected nails loaded into the nail feeding passage is pushed by a rated-output spring of the pusher to supply the connected nails to the cylindrical nose portion. To prevent rearward inclination of the leading end of the stick nails and ejection through an opening for connecting the nose portion and the magazine to each other at the instant when the stick nails is driven by a driver, the nail is supplied such that its leading end is inclined forwards and its head is inclined rearwards.

To supply even a final nail of the stick nails to the nose portion, the pusher must be moved to a position shown in FIG. 9. The foregoing movement, however, causes a leading end 230*a* of the pusher 230 is introduced into the nose portion 231. Therefore, when the driver 232 is operated in the foregoing state, the driver 232 strikes and breaks the leading end 230*a* of the pusher 230 introduced into the nose portion 231. Hence it follows the movement of the pusher 230 must be stopped in front of the nose portion 231. Then, new connected nails must be loaded in a state where a plurality of nails are left in a nail feeding passage 233. The foregoing phenomenon similarly occurs if the conventional feeding claw is employed as a substitute for the pusher.

Next, two types of magazines for a nailing machine is discussed. A magazine for a nailing machine includes a single loading type magazine for accommodating one row of connected nails and a multiple-loading type magazine for arranging and accommodating a plurality of connected nails. Both of the magazines require the nails to be supplied to a nose portion thereof such that the same height of the heads of the connected nails is maintained. The magazine for accommodating a series of connected nails has a linear groove capable of engaging to the projecting heads of the nails and formed in each of the two side walls of the magazine in a direction in which the nails are fed. Since the connected nails are accommodated in a state where the heads of the connected nails are engaged to the linear grooves formed in the two sides of the walls and the nails are suspended, any problem does not arise regardless of the heights of the shafts of the nails. In a case of a multiple-loading magazine, the connected nails are supported by the bottom of the magazine. Therefore, the height of the magazine is adjusted to correspond to the height of the shafts of the nails. Specifically, an adjustment mechanism for adjusting the height of the bottom portion of the magazine is provided for the multiple-loading magazine.

The conventional mechanism for adjusting the height of a magazine for a multiple-loading nailing mechanism has a structure as shown FIG. 4 of JP-B-6-61706, and it has problems such as bad maneuverability and low strength because the conventional mechanism is assembled by fixing plural members with welding. Therefore, when the nailing machine is dropped, these members can be easily bent or broken, so that the nailing machine can not be used anymore.

Another related art on a multiple-loading magazine for connected nails is discussed hereafter. Conventionally, a multiple-loading magazine for connected nails of the conventional type incorporates only one mechanism for feeding the connected nails in the magazine. Therefore, feeding of the nails cannot satisfactorily be performed.

That is, when only one row of connected nails is present in the magazine, the claw for feeding the nail can be disposed sufficiently adjacent to the nose portion of the nailing machine. In a case of the multiple-loading magazine, the feeding claw must feed the innermost connected nails to the nose portion and as well as feeding inner connected nails in a next row to the nail feeding passage from the magazine after the foregoing connected nails have been consumed. Therefore, the conventional feeding claw has been structured to be capable of reciprocating between the magazine and the nail feeding passage to feed the connected nails in the magazine to the nail feeding passage. Therefore, the feeding claw is disposed at a rear position (adjacent to the magazine) apart from the nose portion as compared with the feeding claw of the single loading feeding claw.

The feeding claw is required to feed a next nail to the nose portion whenever a nail is driven. Therefore, the operation stroke is determined to be a short stroke which is formed to feed one nail to a next nail position. When the final one of the connected nails has been fed, the position of the feeding claw is nearest the nose portion. However, the distance from the feeding claw to the nose portion is considerably long. Since furthermore feeding cannot be performed, there arises a problem in that substantially 410 nails in the rear portion of the connected nails are left.

Next, a related art on a multiple-loading magazine for connected nails is discussed from another point of view. In general, a multiple-loading magazine for connected nails of the foregoing type accommodates a plurality of connected nails in the form of lateral rows. A pushing bar is provided which sequentially pushes out the connected nails starting from the connected nail in the inner row to a nail feeding passage connected to a nose portion of a nailing machine. The pushing bar is urged so as to be engaged to the shaft of the connected nail in the outermost row which is on standby in the magazine so that the nail is pushed out to the inside portion. The pushing bar has a function for inwards pushing out the next connected nails to the nail feeding passage after the inner connected nails have been consumed, that is, when the inner connected nails have been discharged from the magazine.

The operation for driving a nail includes downward driving with which the nail is driven into a floor, lateral driving with which a nail is driven into a wall and upward driving with which a nail is driven into a ceiling. The direction of the nailing machine varies to correspond to the foregoing operations. The direction of the connected nails in the magazine is, therefore, varied. When the downward driving operation is performed, the magazine is made to be horizontal and the shafts of the accommodated connected nails face vertically. When the lateral driving operation is performed such that the nail is driven by causing the magazine to face downwards as shown in FIG. 21A, the connected nails face vertically. When the magazine is caused to face laterally as shown in FIGS. 21B and 21C the connected nails and their shafts are positioned horizontally.

Therefore, the connected nails in the magazine are relatively stable when the downward driving operation is performed. Hence it follows that the outer connected nails are pushed out to the inside portion owing to spring force of the pressing bar after the innermost connected nails have been discharged from the magazine.

When the lateral driving operation is performed as shown in FIG. 21A, the connected nail 500*a* is slid and dropped owing to its deadweight. If the connected nail 500*a* in the magazine is moved whenever the direction of the nailing machine is changed, the operability deteriorates. In a case shown in FIG. 21B, a state is realized in which the connected nail 500*a* is placed on the pressing bar 500*b*. Therefore, the spring force of the pressing bar 500*b* is reduced owing to the deadweight of the connected nail. If the innermost connected nails are discharged from the magazine in the foregoing state, the pressing bar 500*b* cannot easily push up the inner connected nails 500*a* to the inside portion (the upper portion of the drawing). If the spring force of the pressing bar is enlarged, the connected nails 500*a* can be pushed up. The separator arranged to perform the introducing and removing operations whenever the nail is fed is disposed between the connected nails in the first row which is the inner most row and the connected nails in the second row which is inner than the first row. The reason for this lies in that undesirable engagement between the shafts of the connected nails in the first and second rows which obstructs feeding of the nail must be prevented. Therefore, if the spring force of the pressing bar is enlarged excessively, there arises a problem in that the separator cannot be introduced in between the connected nails because the force for connecting the adjacent connected nails is enlarged excessively.

SUMMARY OF THE INVENTION

Accordingly, the present invention is devised with considering the above mentioned problems, and objects of the present invention are discussed hereafter with the following examples.

An first object of the present invention is to provide a multiple-loading magazine mechanism which is capable of solving the above problems and providing a simple structure and with which weight reduction is permitted.

To solve the problems, there is provided a multiple-loading magazine mechanism for a nailing machine comprising a nail feeding passage and first and second guiding portions. The nail feeding passage is for guiding one of plural rows of connected nails to a striking mechanism of the nailing machine. The first guiding portion faces the nail feeding passage, and the first guiding portion is rotatively disposed and arranged to separate one of the rows of the connected nails from the others. A second guiding portion is for feeding the connected nails.

It is also preferable that a multiple-loading magazine mechanism comprises: an opened nail feeding passage for guiding and supplying connected nails to either end of a cylindrical nose connected to a striking mechanism; and a plurality of branched passages in a branched shape formed along either end of the nail feeding passage, wherein the nail feeding passage and each of the branched passages are able to accommodate a series of the connected nails, each of the branched passages has a pusher for pushing out the connected nails accommodated in each of the branched passages to the nail feeding passage, and a seesaw block is disposed in a portion of the nail feeding passage opposite to an opening of each of the branched passages, the seesaw block being arranged to swing to permit movement of a forward connected nail pushed out through the opening and positioned adjacent to the nose, stop a next connected nail pushed out through the opening of the branched passages when the connected nail is present in the nail feeding passage and permit movement of the next connected nail after the front connected nail has been moved.

More specifically, a structure may be employed in which a seesaw block which is capable of swinging about a central support point thereof and which is movable perpendicularly to a direction in which the nail is fed is disposed in a portion of the nail feeding passage opposite to an opening of each branched passage such that the seesaw block is urged by a spring toward the nail feeding passage, projections which can be introduced/removed with respect to the nail feeding passage are provided for two ends of the seesaw block along the nail feeding passage at positions corresponding to the front and rear portions of the opening, the rear surface of the front projection adjacent to the nose is formed into an inclined surface inclined with respect to the direction in which the connected nails are fed, and the front projection is urged to always be moved to the nail feeding passage.

An second object of the present invention is to provide a multiple-loading magazine mechanism which solves the above problems and is capable of driving a final one of a stick-nail type connected nails.

To solve the problems, there is provided a mechanism for guiding connected nails for a magazine of a nailing machine comprising: a nail feeding passage formed continuously from a rear wall of a cylindrical nose portion formed continuously from a striking mechanism and arranged to guide and supply connected nails connected such that the heads of the nails overlap; an opened window formed in a side wall of the nail feeding passage and provided with a nail feeding claw arranged to reciprocate in a direction in which the nail is supplied such that the nail feeding passage is able to be engaged/separated with respect to the shaft of each of the connected nails; and a pushing block disposed adjacent to the nose portion and arranged to be movable to be engaged to the rear surface of the head of a final connected nail and to push out the final nail to the nose portion.

It is preferable that the pressing block is urged by a spring so as to be rotatively disposed adjacent to the nose portion, usually engaged to the side surface of the head of the connected nail and arranged to push out the rear surface of the head of a final nail of the connected nails when the final nail passes aside the pressing block.

It is preferable that movement of the pressing block is inhibited so that introduction of the pressing block into the nose portion is inhibited.

A third object of the present invention is to provide a mechanism for adjusting the height of a magazine for a multiple-loading magazine mechanism which is To solve the foregoing problem, there is provided a mechanism for adjusting the height of a magazine for a multiple-loading nailing machine for loading a plurality of arranged connected nails, comprising: a bottom plate disposed between two side walls of a magazine, arranged to support connected nails and capable of moving vertically; and a plurality of engaging portions vertically provided for the inner walls of the two side walls, wherein engaging means capable of engaging/separating with respect to the engaging portion is provided for the bottom plate.

It is preferable that a portion of a lower portion of each of the two side walls of the magazine is opened, and the bottom plate is exposed to the outside through the opened portion.

An fourth object of the present invention is to provide a nail feeding mechanism for a multiple-loading magazine for a nailing machine capable of solving the foregoing problems and reliably feeding nails even if only a small number of nails is left.

To solve the foregoing problem, according to one aspect of the present invention, there is provided a nail feeding mechanism for a multiple-loading magazine for a nailing machine adaptable to a multiple-loading magazine formed to permit a plurality of connected nails obtained by connecting a multiplicity of nails in the form of sticks to be loaded from inside to the outside such that the connected nails are formed in the lateral row state so as to feed the connected nails starting with the connected nails in the innermost first row to a rearward nose portion of a nailing machine through a nail feeding passage, the nail feeding mechanism for a multiple-loading magazine for a nailing machine comprising:

two pieces of feed-piston cylinder apparatus disposed at two positions along the nail feeding passage and each having a feed piston capable of reciprocating in the lengthwise direction, wherein the feed piston of the rear feed-piston cylinder apparatus is provided with a separator which is capable of separating, to the inside pusher and the outside portion, a first row of the connected nails at the innermost position and a second row of the connected nails on the outside of the first row of the connected nails and a first feeding claw for feeding the connected nails in the first row from the magazine to the nail feeding passage, and the feed piston of the front feed-piston cylinder apparatus is provided with a second feeding claw for feeding the connected nails fed by the first feeding claw to the nose portion.

It is preferable that the second feeding claw is formed to be capable of engaging to a nail regardless of the length of the nail.

An fifth object of the present invention is to provide a mechanism for holding connected nails for a multiple-loading magazine of a nailing machine which is capable of holding connected nails in the magazine to prevent undesirable movement and reliably pushing out the standby connected nails regardless of the driving method.

To solve the problems, according to the present invention, there is provided a mechanism for holding connected nails for a multiple-loading magazine of a nailing machine adaptable to a multiple-loading magazine having a structure to which loading of a plurality of connected nails formed by linearly connecting a multiplicity nails in a lateral state from inside to the outside is permitted and which sequentially pushes out the connected nails starting with a connected nail in the inner row to a nail feeding passage connected to a nose portion of a nailing machine, the mechanism for holding connected nails for a multiple-loading magazine of a nailing machine, comprising: a pressing bar and a plate spring disposed in the magazine such that the pressing bar is urged to engage to the shaft of a connected nail in the outermost row in the magazine to inwards push out the nail and provided individually, wherein the plate spring is disposed below the pressing bar, and the plate spring has a bent engaging portion which is introduced in between connected nails in the outermost row through the connected nails in the inner row of standby connected nails in the magazine so as to be engaged in between the connected nails.

DETAILED DESCRIPTION OF THE PREFERRED EMBODIMENTS

Now, referring to FIGS. 1–5, the first embodiment of the present invention is specifically described.

Figure 1:
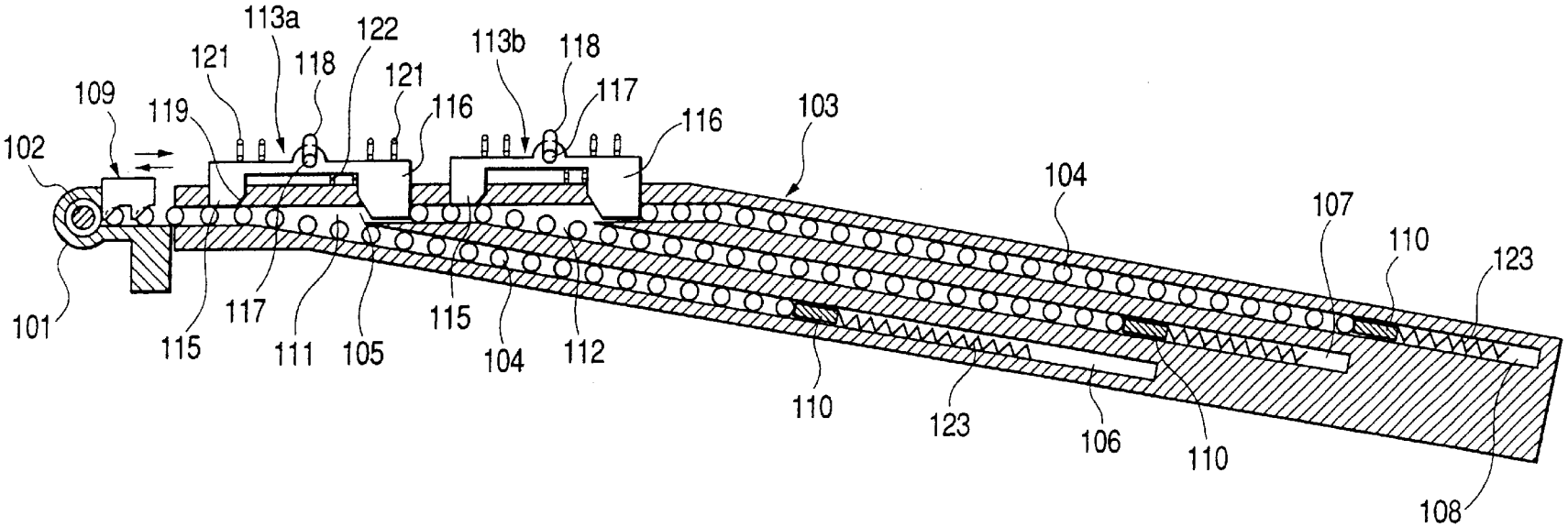
FIG. 1 is a lateral cross sectional view showing-an essential portion of a multiple-loading magazine mechanism according to the present invention.

Referring to FIG. 1, reference numeral 101 represents a nose portion provided for the body of a nailing machine. The nose portion 101 has a cylindrical shape formed continuously from a striking mechanism and arranged to slidably accommodate a driver 102 stricken by the striking mechanism. Moreover, the nose portion 101 receives a lead end nail of connected nails 104 supplied from a magazine 103. Note that the head of the connected nail 4 is omitted from illustration in all of the drawings.

The magazine 103 has an opened nail feeding passage 105 for guiding and supplying the connected nails 104 to an end portion of the nose portion 101. A plurality of (three in this embodiment) branched passages 106, 107 and 108 are branched from an end portion of the nail feeding passage 105. Also the nail feeding passage 105 and the branched passages 106, 107 and 108 are formed to be capable of slidably holding a series of the connected nails 104. The connected nails 104 in the nail feeding passage 105 can be guided and supplied to the nose portion 101, while the connected nails 104 in the branched passages 106, 107 and 108 can be guided and supplied to the nail feeding passage 105.

A connected nails 104 provided for a feeding mechanism and capable of moving in the lengthwise direction is disposed adjacent to the nose portion 101. When the feeding claw 109 is moved forwards, the feeding claw 109 is engaged to the shaft portion of the connected nail 4 in the nail feeding passage 105 so as to feed one connected nail 4. When the feeding claw 109 is moved rearwards, the feeding claw 109 is moved away from the shaft of the connected nail 4. Note that the nail feeding mechanism is not limited to the feeding claw 109. For example, a mechanism may be employed which sandwiches the shaft of the nail from right and left portions to feed the nail.

A pusher 110 is disposed at the rear of each of the branched passages 106, 107 and 108. Each pusher 110 is forwards urged by a spring 123. The end of movement of the pusher 110 caused by the spring 123 is slightly in front of a joint portion to the nail feeding passage 105.

Front and rear seesaw blocks 113*a* and 113*b* are disposed in the nail feeding passage 105 at positions opposite to openings 111 and 112 of the front and second branched passages 105 and 106. Each of the seesaw blocks 113*a* and 113*b* has front and rear projections 115 and 116 formed such that the front projection 116 projects greater than the front projection 115. A shaft 117 serving as a support point is disposed in the central portion of each of the seesaw blocks 113*a* and 113*b*. The shaft 117 is engaged to an elongated hole 118 provided for the body of the nailing machine and formed in a direction perpendicular to a direction in which the nail is fed. The seesaw blocks 113*a* and 113*b* performs seesaw motions around the support point so that the projections 115 and 116 at the front and rear ends of each of the seesaw blocks 113*a* and 113*b* are introduced into the nail feeding passage 105. As an alternative to this, the projections 115 and 116 are removed from the nail feeding passage 105. The projections 115 and 116 are formed at positions corresponding to the front and rear portions of the opening 111. An end of the front projection 115 is formed to have a right angle to permit the front end to be engaged to the shaft of the nail. A rear surface 119 is formed into an inclined surface which is inclined with respect to the direction in which the connected nails 104 are fed. Moreover, springs 121 for pressing the seesaw blocks 113*a* and 113*b* against the nail feeding passage 105 are disposed in the front and rear portions of the rear surface of each of the seesaw blocks 113*a* and 113*b*. Also springs 122 are disposed in the rear portions of the seesaw blocks 113*a* and 113*b* adjacent to the nail feeding passage 105. Owing to the spring forces of the springs 121 and 122, the front projection 115 of each of the seesaw blocks 113*a* and 113*b* is always moved to the nail feeding passage 105. On the other hand, the rear projection 116 is removed from the nail feeding passage 105.

The spring force of the spring 123 of the pusher 110 is larger than that of the spring 121 of each of the seesaw blocks 113*a* and 113*b*.

The operation of the multiple-loading magazine mechanism structured as described above will now be described.

Figure 2:
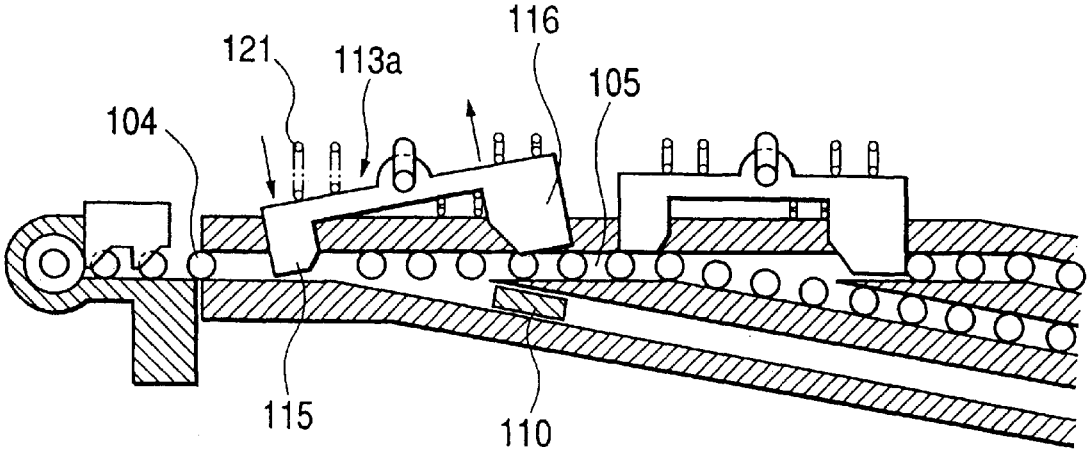
FIG. 2 is a diagram showing the operation of the multiple-loading magazine mechanism.
Figure 3:
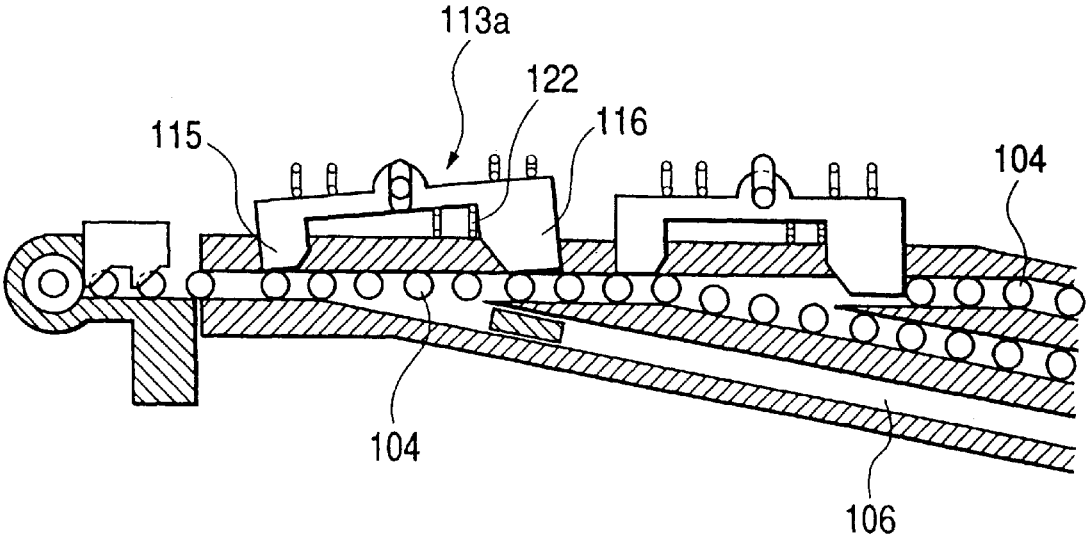
FIG. 3 is a diagram showing a next operation of the multiple-loading magazine mechanism.
Figure 4:
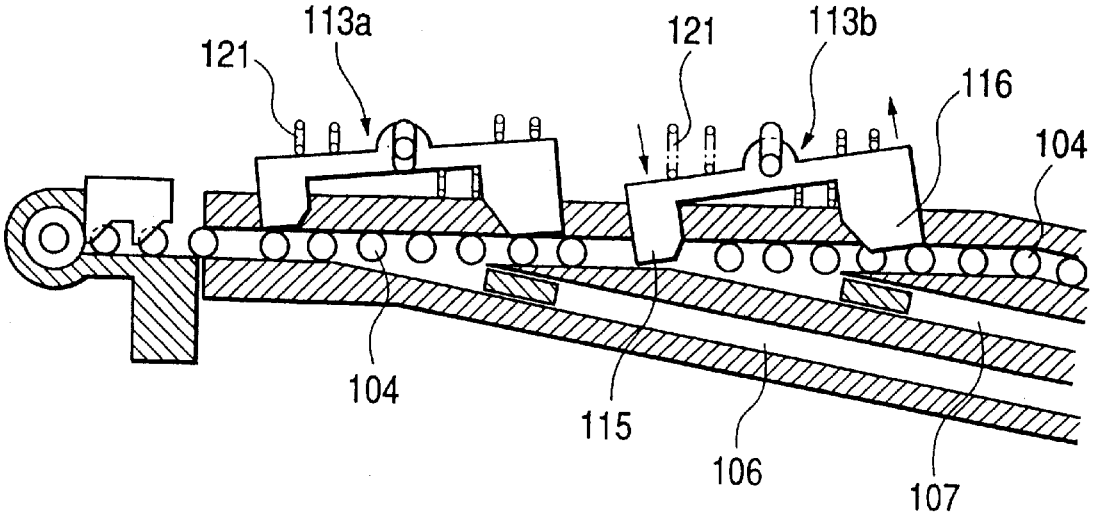
FIG. 4 is a diagram showing a next operation of the multiple-loading magazine mechanism.
Figure 5:
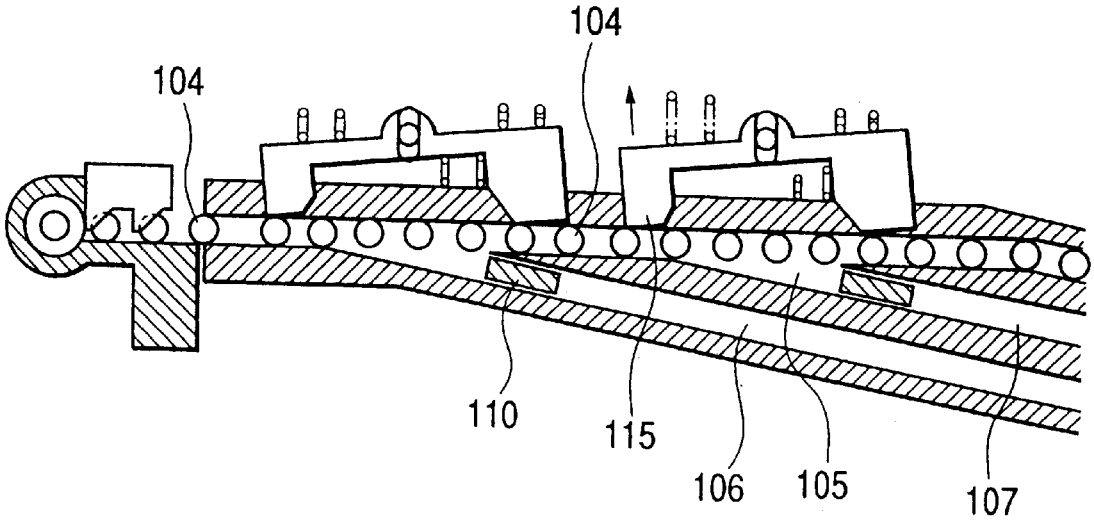
FIG. 5 is a diagram showing a final operation of the multiple-loading magazine mechanism.

The pusher 110 of each of the branched passages 106, 107 and 108 is moved to the rear end to load a series of the connected nails 104 into the inside portion of each of the branched passages 106, 107 and 108. As shown in FIG. 1, the connected nails 104 in the first row in the branched passages 106 are pushed out to the nail feeding passage 105 by the pusher 110. The leading end nail is engaged to the inclined rear surface 119 of the front projection 115 of the front seesaw block 113*a* moved into the nail feeding passage 105. Since the leading nail slides on the inclined surface 119, the projection 115 of the seesaw block 113*a* is pushed out so as to be removed from the nail feeding passage 105. Thus, movement of the connected nail 4 through the nail feeding passage 105 is permitted. On the other hand, the rear projection 116 is engaged to the connected nails 104 in the second row to inhibit the movement of the second row connected nails 104. Also the rear seesaw block 113*b* is brought to the same state. Also the front portion of the connected nails 104 in the third row is introduced into the nail feeding passage 105. The foregoing front portion is engaged to the rear projection 116 of the rear pusher 10 so that furthermore forward movement of the connected nail 4 is inhibited. When the connected nails 104 in the first row have been consumed and the final nail has passed aside the front projection 115 of the pusher 110 as shown in FIG. 2, the projection 115 is moved into the nail feeding passage 105 by the spring 121. Therefore, the seesaw block 113*a* is swung to retreat the rear projection 116 so that the connected nails 104 in the second row are pushed forwards by the pusher 110. Also the front projection 115 is removed from the nail feeding passage 105 as shown in FIG. 3 so as to be engaged and continued to the trailing end of the front connected nails 104. Then, the connected nails 104 in the second row is moved forwards as shown in FIG. 4 so that the final nail passes aside the front projection 115 of the rear seesaw block 113*b*. Thus, the projection 115 is moved into the nail feeding passage 105 by the spring 121. Therefore, the seesaw block 113*b* is swung so that the rear projection 116 is retreated and the connected nails 104 in the third row are pushed forwards by the pusher 110. Since the front nail feeding passage 105 is retreated as shown in FIG. 5, both of the front and rear seesaw blocks 113*a* and 113*b* are retreated from the nail feeding passage 105. Therefore, the connected nails 104 in the third row follow the connected nails 104 in the second row so as to move in the nail feeding passage 105 toward the nose portion 101. Thus, all of the connected nails 104 loaded into the magazine 103 are sequentially and successively consumed. After the front end of each series of the connected nails 104 has been moved to the position of the feeding claw 109, the connected nails 104 are moved to the nose portion 101 by the feeding claw 109.

As described above, the multiple-loading magazine mechanism according to the present invention has a simple structure that the plural branched passages 106, 107 and 108 are branched from the end of the nail feeding passage 105 and the seesaw blocks 113*a* and 113*b* are provided for the nail feeding passage 105. Therefore, the structure can be simplified and the overall weight can be reduced.

Since the front end of the final connected nails 104 reaches the position of the feeding claw 109 before the final connected nails 104 is pushed out by the pusher 110, any problem, such as intermediate miss-striking, can be prevented. That is, all of the nails can successively be driven.

Now, referring to FIGS. 6–9, the second embodiment of the present invention is specifically described.

Figure 6:
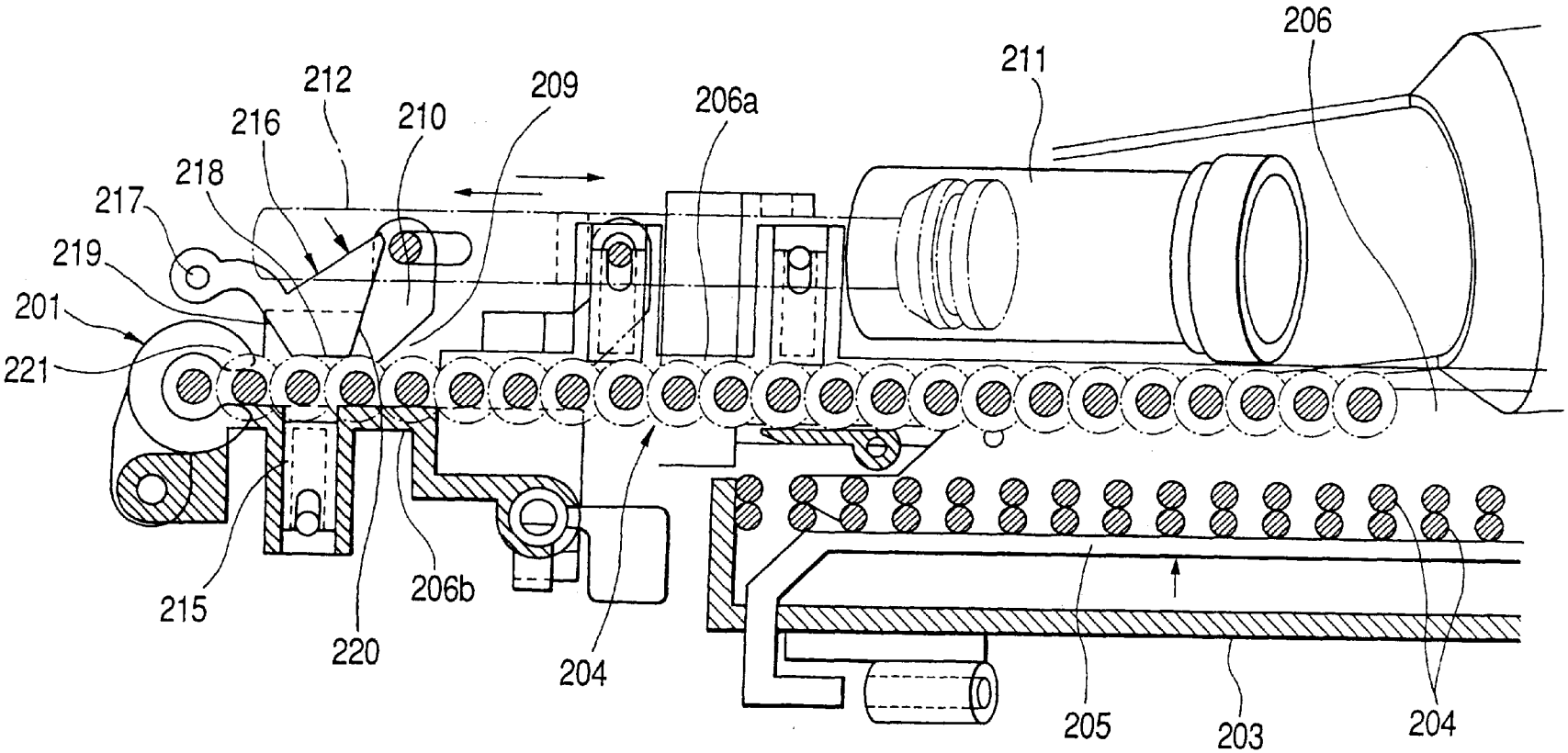
FIG. 6 is a plan view showing an essential portion of a guiding mechanism for connected nails in a magazine of a nailing machine according to the present invention.
Figure 7:
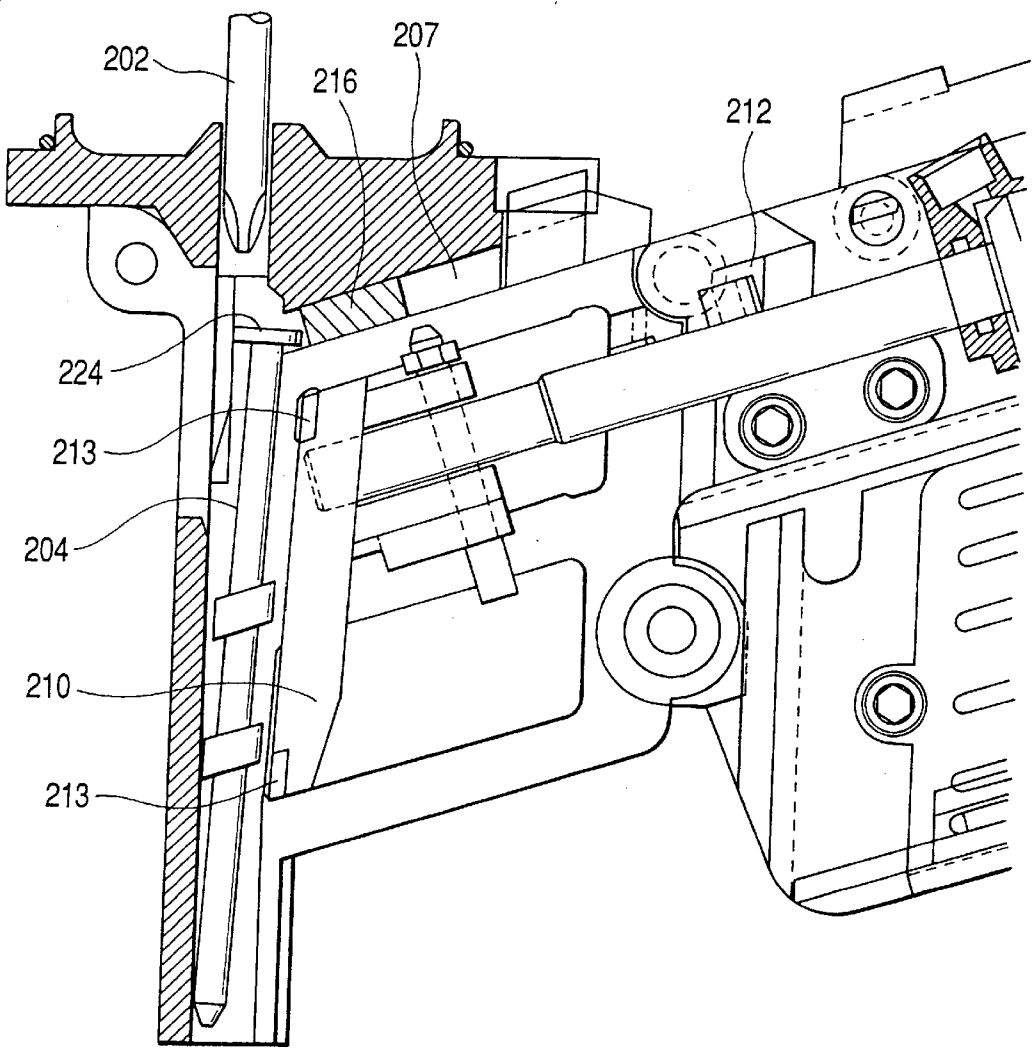
FIG. 7 is a side view showing the essential portion of the mechanism for guiding the connected nails.

Referring to FIGS. 6 and 7, reference numeral 201 represents a nose portion 201 provided for the body of a nailing machine. The nose portion 201 has a cylindrical shape formed continuously from a striking mechanism to be capable of slidably accommodating a driver 202 struck by a striking mechanism and receiving a leading end nail of a connected nails (stick nails) 204 supplied from a magazine 203. Note that the connected nails 204 are formed similarly to the conventional structure such that the shaft of nail 204 is inclined rearwards as compared with the axis of the nose portion 201.

Three rows of connected nails 204 are accommodated in the magazine 203. The connected nails 204 in the first row are, by a spring 205, sequentially supplied to a nail feeding passage 206 for guiding and supplying the connected nails 204 to the nose portion 201. A guide groove 207 arranged to be engaged to the head of the connected nail 204 to guide the head of the nail 204 is formed in the upper portion of the nail feeding passage 206. An opened window 209 is provided for one of guide walls 206*a* of the nail feeding passage 206. A feeding claw 210 capable of reciprocating in a direction in which the nails 204 are supplied faces the opened window 209. The feeding claw 210 is rotatively joined to the leading end of a rod 212 provided for an air cylinder unit 211 disposed on the outside of the nail feeding passage 206. The feeding claw 210 is urged by a spring so as to always be introduced into the nail feeding passage 206 so as to be engaged to the shaft of the connected nail 204. When the feeding claw 210 is moved forwards, the feeding claw 210 is engaged to the shaft of a third nail counted from the leading end nail of the connected nails 204 in the nail feeding passage 206 to feed the connected nails 204 for a distance corresponding to one nail. When the feeding claw 210 is moved rearwards, the feeding claw 210 is separated from the shaft of the nail. Note that upper and lower claws 213 are provided for the feeding claw 210. When the feeding claw 210 is at the forward movement end, limitation as shown in FIG. 7 is imposed such that its upper end of the front portion is engaged to the shaft portion of the second nail. Moreover, the lower end of the front portion is at the position immediately before the inside portion of the nose portion 201.

A stopper claw 215 which is capable of introducing into the nail feeding passage 206 is joined to another guide wall 206*b* of the nail feeding passage 206 such that the stopper claw 215 is urged by a spring so as to be introduced into the nail feeding passage 206. The leading end of the stopper claw 215 is inclined so that the inclined surface is engaged to the shaft of the nail when the connected nails 204 are moved forwards, and the stopper claw 215 is retreated from the nail feeding passage 206. When the connected nails 204 are moved rearwards, the inclined surface is engaged to the shaft of the nail so that the movement of the connected nails 204 is inhibited.

A pressing block 216 which is rotatable around a support shaft 217 is disposed adjacent to the nose portion 201. The pressing block 216 is urged by a spring so as to be introduced into the nail feeding passage 206 and engaged to the head of the connected nail 204 to face the guide groove 207 for guiding the head of the nail 204 on the same side as the feeding claw 210. The pressing block 216 has an engaging surface 218 arranged to be engaged to the side surface of the connected nail 204 in the nail feeding passage 206; a pressing surface 219 arranged to be engaged to the rear portion of a final nail of the connected nails 204; and an inclined surface 220 formed in the rear of the pressing surface 219. The engaging surface 218 is formed to be capable of pressing the heads of second and third nail in the rear of the nose portion 201. The engaging surface 218 is formed such that the front pressing surface 219 and the rear inclined surface 220 make an obtuse angle.

A portion of the nose portion 201 is cut so that introduction of a portion of the pressing block 216 into the wall of the nose portion 201 is permitted from a cutout 221. However, the engaging surface 218 is engaged to an end portion 222 of the opening of the nose portion 201 so that introduction of the pressing block 216 into the nose portion 201 is inhibited.

After the connected nails 204 have been loaded into the nail feeding passage 206 of the magazine 203 structured as described above, the connected nails 204 are accommodated such that the axes of the shafts of the connected nails 204 are inclined rearwards. When the air cylinder unit 211 has been operated to perform the nailing operation, the feeding claw 210 reciprocates. Thus, the feeding claw 210 is engaged to the shaft of the connected nail 204 when the feeding claw 210 is moved forwards to move the connected nails 204 forwards. As a result, the leading end nail is supplied to the nose portion 201. Then, the feeding claw 210 is moved reversely to the original position. Then, an operating mechanism (not shown) is operated so that the driver 202 is driven along the nose portion 201. Thus, the leading end nail in the nose portion 201 is struck so that the leading end nail is driven into a subject member from the leading end of the nose portion 201. After the leading end nail has been driven, the air cylinder unit 211 is again operated. Thus, the feeding claw 210 supplies a next leading end nail to the nose portion 201.

In a state where the operation for feeding the nail is performed, the pressing block 216, as shown in FIG. 6, is brought to a state where its engaging surface 218 of the pressing block 216 is brought into contact with the side surface of the connected nail 204. Thus, introduction into the nail feeding passage 206 is inhibited.

Thus, the nails in the nose portion 201 are sequentially driven until two final nails are left in the nose portion 201.

Figure 8A:
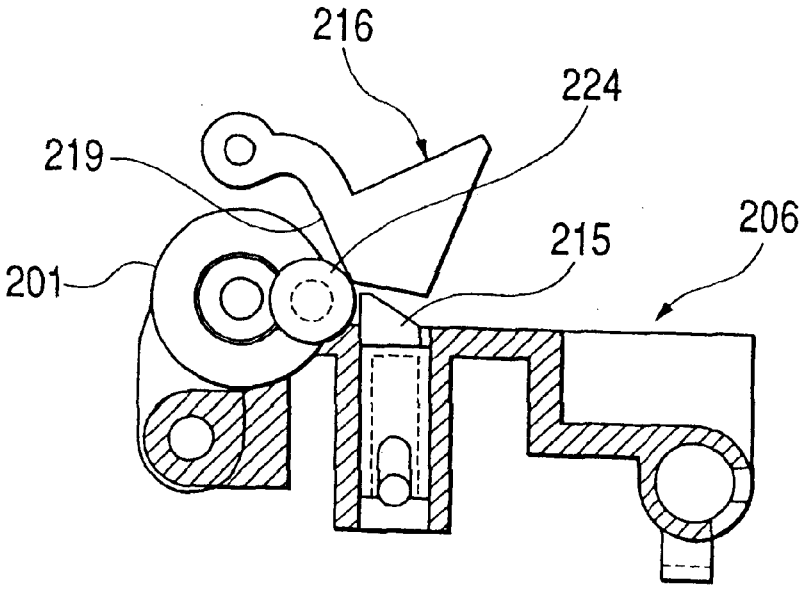
FIGS. 8A and 8B are diagrams showing the operation of the guide mechanism.
Figure 8B:
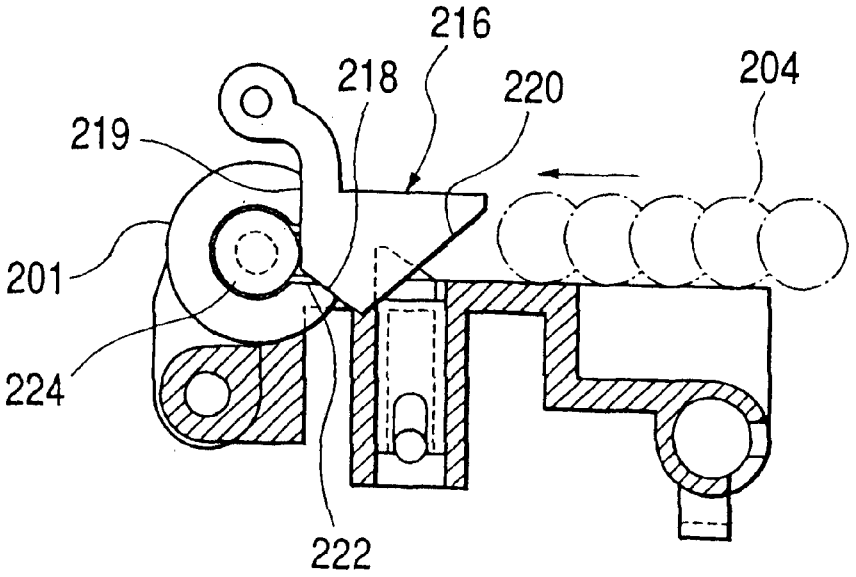
Figure 9:
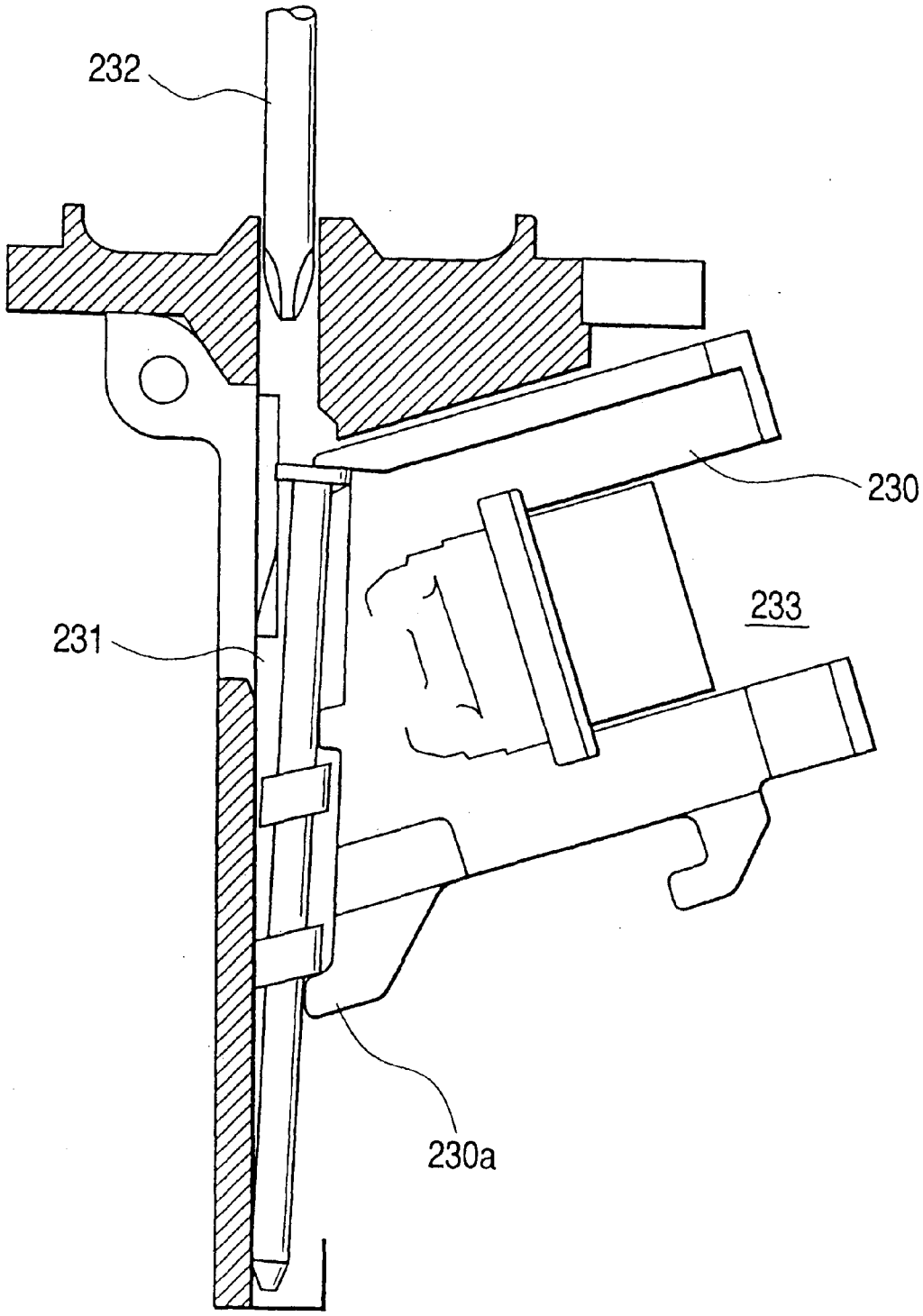
FIG. 9 is a diagram showing a structure with which even a final nail is supplied to the nose portion.

Then, the pressing block 216 is, as shown in FIG. 8A, engaged to the rear portion of the head 224 of the nail second from the final nail. When the nail in the nose portion 201 has been driven, the pressing surface 219 pushes out the rear surface of the head 224 of the final nail as shown in FIG. 8B to move the final nail to the nose portion 201. The state of pressing is maintained to hold the final nail so that inverse movement of the head 224 to the supply side is inhibited. Therefore, correct attitudes of the upper and lower portions of the nail are maintained by the pressing block 216 and the feeding claw 210, respectively. Note that the engaging surface 218 of the pressing block 216 is, at this time, engaged to the end portion 222 of the opening of the nose portion 201. Thus, introduction of the pressing block 216 into the nose portion 201 is inhibited.

After the driver 202 has struck the final nail, the final nail held to have correct attitudes can reliably be driven. Since the pressing block 216 engaged to the head 224 of the nail is not introduced into the nose portion 201 as shown in FIGS. 7 and 8B, the pressing block 216 is not struck by the driver 202. Since the shaft of the foregoing nail is inclined rearwards as compared with the axis of the nose portion 201, that is, the leading end of the nail is reliably introduced into the nose portion 201, a problem which arises in that the leading end of the nail is ejected to the magazine 203 when the driving operation is performed can be prevented.

Then, the front end of new connected nails 204 is engaged to the rear inclined surface 220 of the pressing block 216 as shown in FIG. 8B so that the pressing block 216 is pushed forwards by the drive force of the connected nails 204. Thus, the inclined surface 220 is pushed outwards so that the connected nails 204 are pushed out to the outer portion and removed from the nail feeding passage 206. Therefore, new connected nails 204 are moved through the nail feeding passage so as to be supplied to the nose portion 201. As shown in FIG. 6, the engaging surface 218 of the pressing block 216 is brought into contact with the side surface of the head 224 of the connected nail 204.

As described above, the connected nails 204 are moved to the nose portion 201 such that the shaft of the connected nail 204 is inclined rearwards as compared with the axis of the nose portion 201. When the nail has been moved, the lower end of the front portion of the pusher is at the position immediately before the nose portion 201. Therefore, a problem that the driver 202 strikes the pusher and thus the pusher is broken can effectively be prevented.

The final nail of the connected nails 204 is pushed to the nose portion 201 owing to the engagement of the pressing block 216 to the rear surface of the head 224 of the nail in place of the feeding claw 210. Since the pressing block 216 is engaged to the end portion 222 of the opening of the nose portion 201 and introduction of the pressing block 216 into the nose portion 201 is inhibited, the pressing block 216 is not struck by the driver 202.

In the foregoing embodiment, the pressing block 216 is disposed to be rotatable around the support shaft 217, but the pressing block 216 is not limited to the rotatable pressing block. The pressing block 216 may linearly reciprocate.

The foregoing structure is effective when it is applied to a multiple-loading magazine. The structure for feeding the nails is not limited to the feeding claw. A pusher may be employed.

Figure 10:
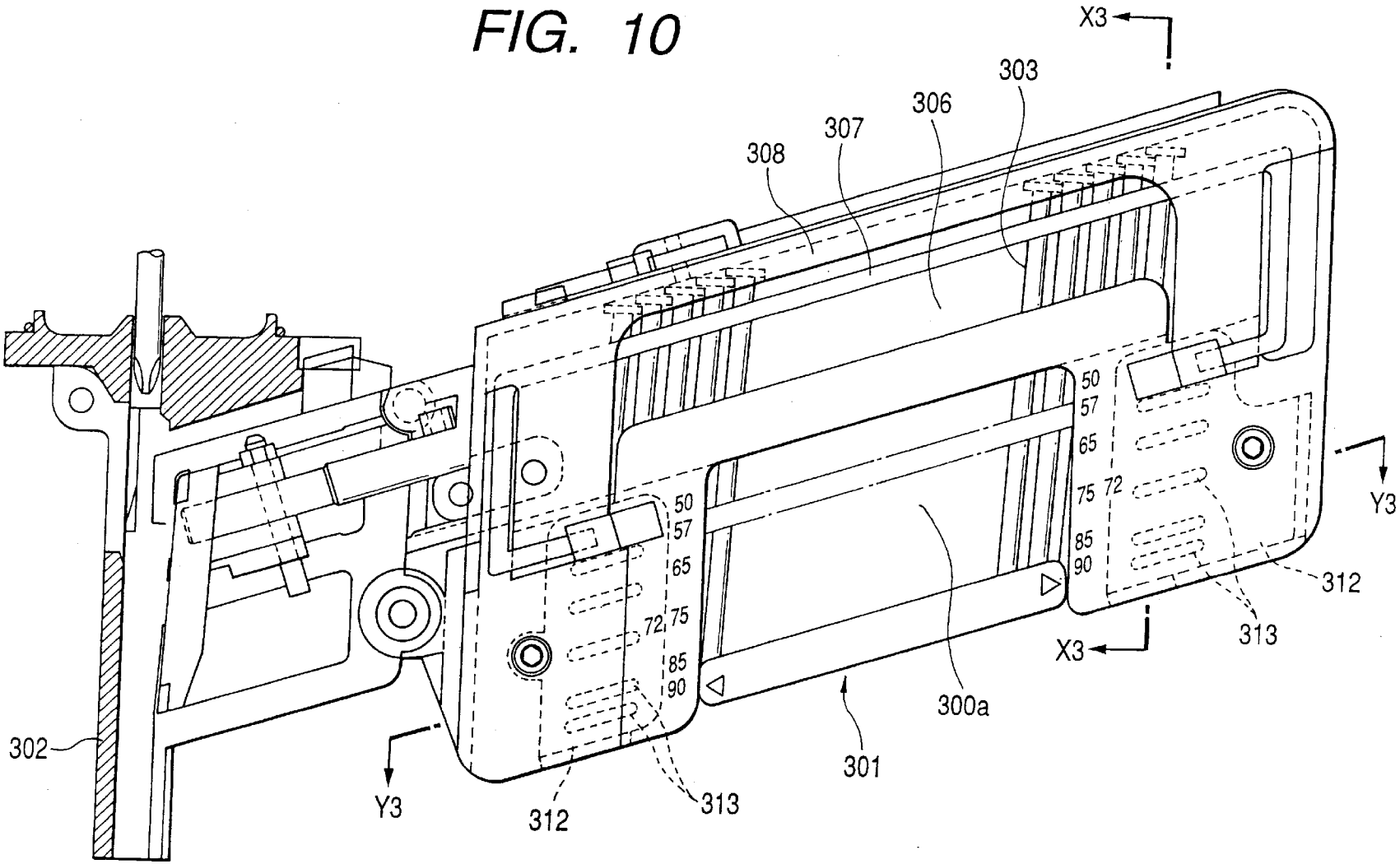
FIG. 10 is a side view showing an essential portion of a magazine for a multiple-loading nailing machine incorporate a mechanism for adjusting the height according to the present invention.
Figure 11:
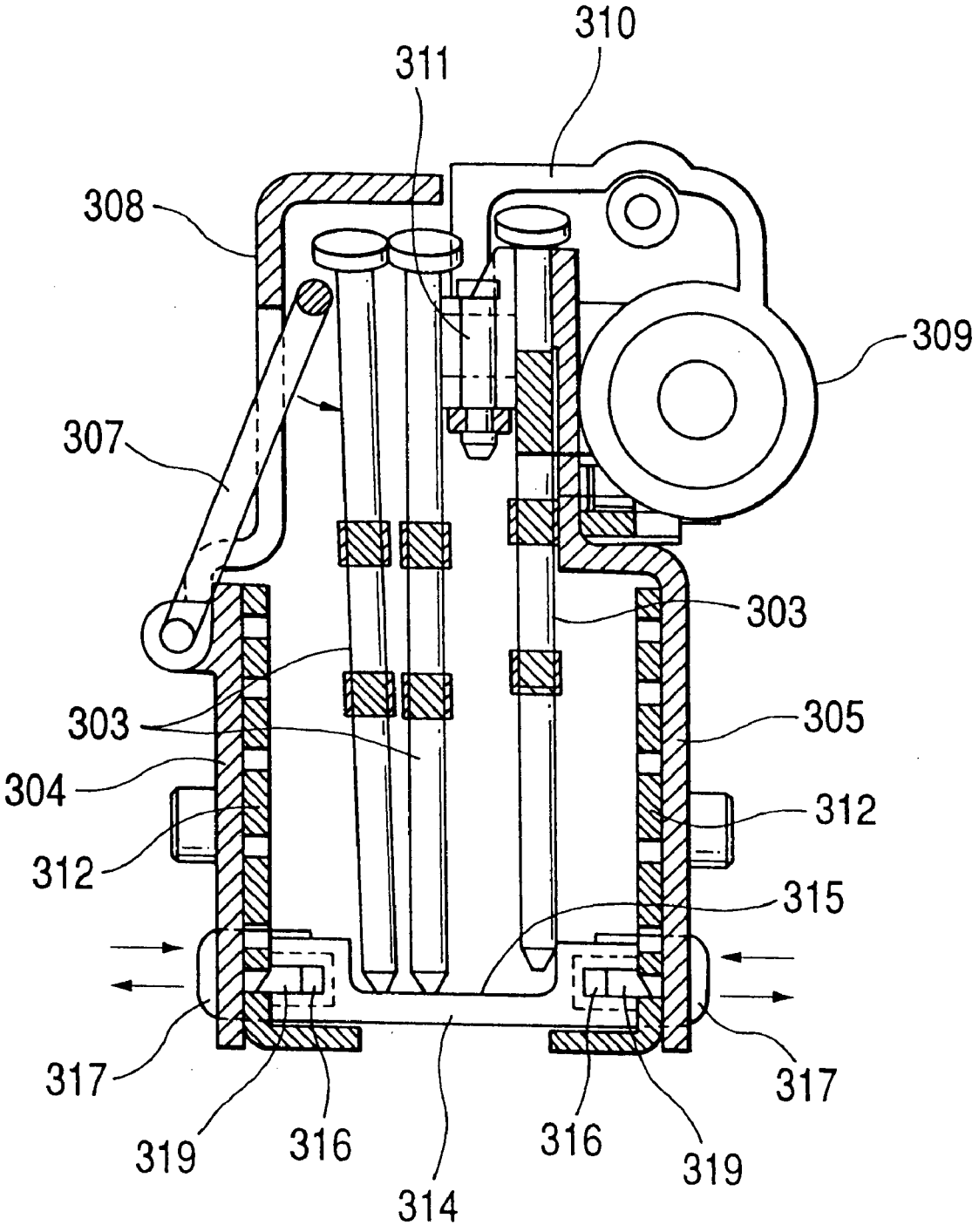
FIG. 11 is a cross sectional view taken along line X3—X3 shown in FIG. 10.
Figure 12:
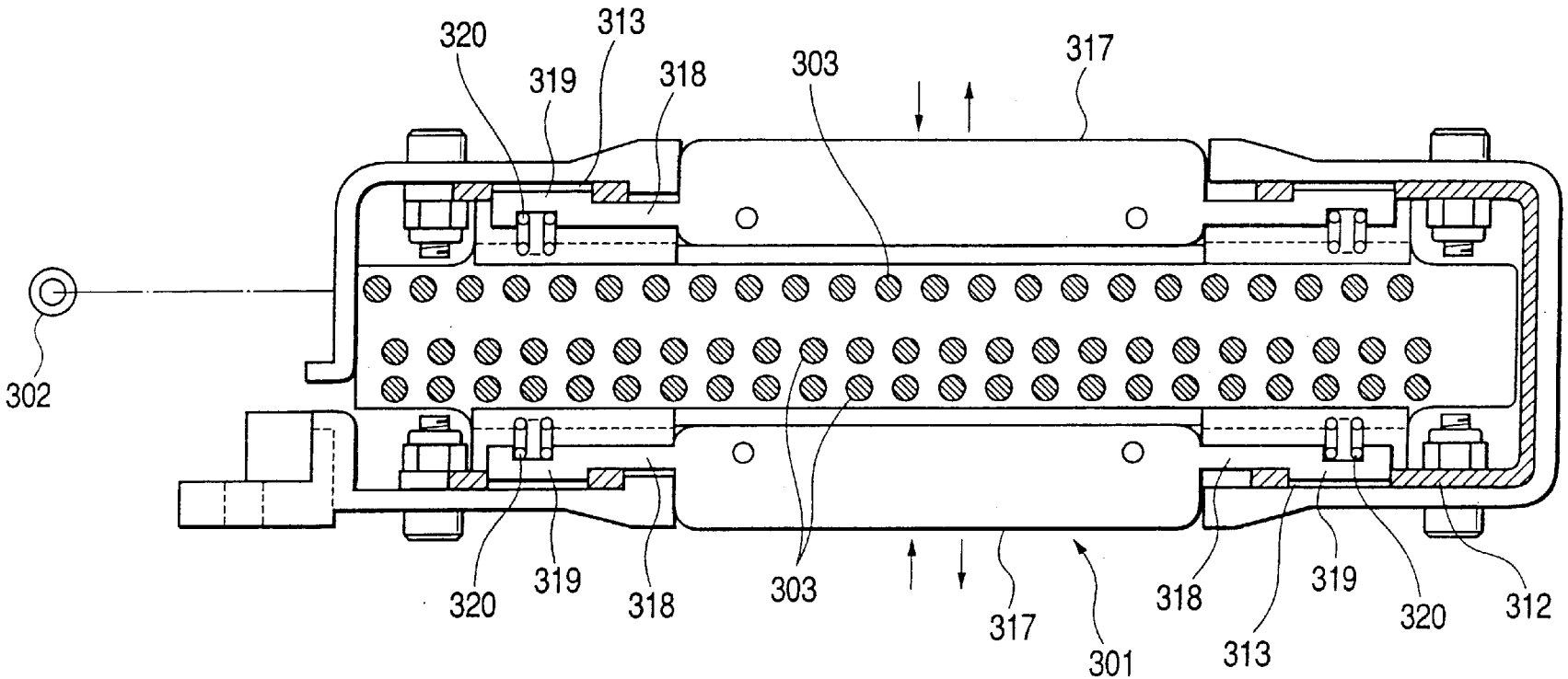
FIG. 12 is a cross sectional view taken along line Y3—Y3 shown in FIG. 10.

Now, referring to FIGS. 10–12, the third embodiment of the present invention is specifically described.

Referring to FIGS. 10 to 12, reference numeral 301 represents a magazine of a nailing machine and 302 represents a nose portion of the nailing machine.

The magazine 301 is a magazine for a multiple-loading nailing machine (three rows of connected nails 303 are arranged and loaded) for a nailing machine. The connected nails 303 in the first row disposed at an end portion thereof (the inside portion) are supplied to the nose portion 302. Two rows of the other connected nails 303 are standby connected nails. The connected nails 303 are stick nails connected in a straight line such that the heads of the nails are in contact with one another.

The lower portions of the central portions of the two side walls 304 and 305 of the magazine 301 are removed so that an opened portion a is formed. The side view in the form of an inverted U-shape is formed. As shown in FIG. 11, a pressing spring 307 is disposed in an opening 306 of the outer side wall 304. The pressing spring 307 presses the outer connected nail 303 to inwards move the connected nail 303. When the connected nails 303 in the first row have been discharged from the magazine 301, the outer connected nails 303 are sequentially inwards moved. Note that a cover 308 is fit to the opening 306 so that the connected nails 303 are loaded to the inside portion after the cover 308 has been opened.

An air cylinder unit 309 for feeding nails is capable of feeding the connected nails 303 in the first row at pitches of one nail to the nose portion 302 and disposed on the outside of the inner side wall. A separating member 311 is joined to the air cylinder unit 309 through a connecting means 310. The separating member 311 is disposed between the connected nails 303 in the first row and the connected nails 303 in the second row so as to smoothly feed the connected nails 303 in the first row without any interference with the connected nails 303 in the second row. When the connected nails 303 in the first row have been discharged from the magazine 301 and the connected nails 303 in the second row are moved inwards, the air cylinder unit 309 also removes the separating member 311 from the magazine 301. When the connected nails 303 in the second row have been moved to the innermost position, the separating member 311 is again introduced into the magazine 301 so as to be introduced between new connected nails 303 in the first row and connected nails 303 in the second row.

A pair of right and left adjusting plates 312 are secured to front and rear inner surfaces of the two side walls 304 and 305 of the magazine 301. A plurality of slits (engaging portions) 313 for adjusting the height are vertically formed in each of the adjusting plates 312. Note that the engaging portions are not limited to the slits 313. For example, pits and projections (not shown) provided for the inner walls of the adjusting plates 312 may be employed.

A bottom plate 314 capable of moving vertically and arranged to support the connected nails 303 is disposed between the two side walls 304 and 305 of the magazine 301. As shown in FIG. 11, a recess 315 formed in the lengthwise direction of the bottom plate 314 is provided for the upper surface of the bottom plate 314. Moreover, recess grooves 316 sandwiching the opened portion 300*a* are formed in the right and let side surfaces. Moreover, operation levers 317 are disposed on the right and left portions of the opened portion 300*a*. Extended portions 318 arranged to be engaged to the inside portion of the front and left recess grooves 316 extend from the operation levers 317. An engaging claw (an engaging means) 319 formed into a wedge shape is provided for the leading end of each of the extended portions 318 at a position corresponding to the slit 313 of the adjusting plate 312. The engaging claw 319 is capable of moving from the recess groove 316, the engaging claw 319 being urged by a spring 320 so that the engaging claw 319 is always allowed to project. When the engaging claw 319 is introduced into the recess groove 316, the right and left operation levers 317 are pulled. Note that the operation levers 317 can be arbitrarily moved in the opened portion a of the magazine 301 in the vertical direction.

In the foregoing structure, the height to the bottom plate 314 is adjusted to correspond to the length of the shafts of the connected nails 303 which are loaded into the magazine 301 as follows: the right and left operation levers 317 are pulled to suspend the engagement between the engaging claws 319 and the slits 313. Then, the height of the bottom plate 314 is adjusted to correspond to the length of the shafts of the connected nails 303 which are loaded into the magazine 301. Then, the pulling force of the operation levers 317 is suspended. Since the bottom plate 314 is exposed into the opened portion 300*a*, the bottom plate 314 can be arbitrarily moved in the vertical direction such that the operation levers 317 and the bottom plate 314 are held. When the pulled operation levers 317 are restored, the engaging claws 319 project owing to the spring to engage to the slits 313. Thus, the bottom plate 314 can be held at a normal position.

The adjustment of the height can easily be performed regardless of a fact whether or not the connected nails 303 have been loaded. When the connected nails 303 have been loaded, the position at which the head of the nail comes in contact with the upper surface of the magazine 301 is an appropriate position. Therefore, the adjustment can reliably be performed.

As described above, the foregoing magazine mechanism facilitates the operation for adjusting the height of the bottom plate 314. Since another member is not secured to the bottom plate 314 by welding or the like, a strong structure can be formed. When the two side walls 304 and 305 are made of plastic and the adjusting plates 312 is made of metal, the magazine 301 exhibiting light weight and satisfactory strength can be obtained.

Now, referring to FIGS. 13–16B, the fourth embodiment of the present invention is specifically described.

Figure 13:
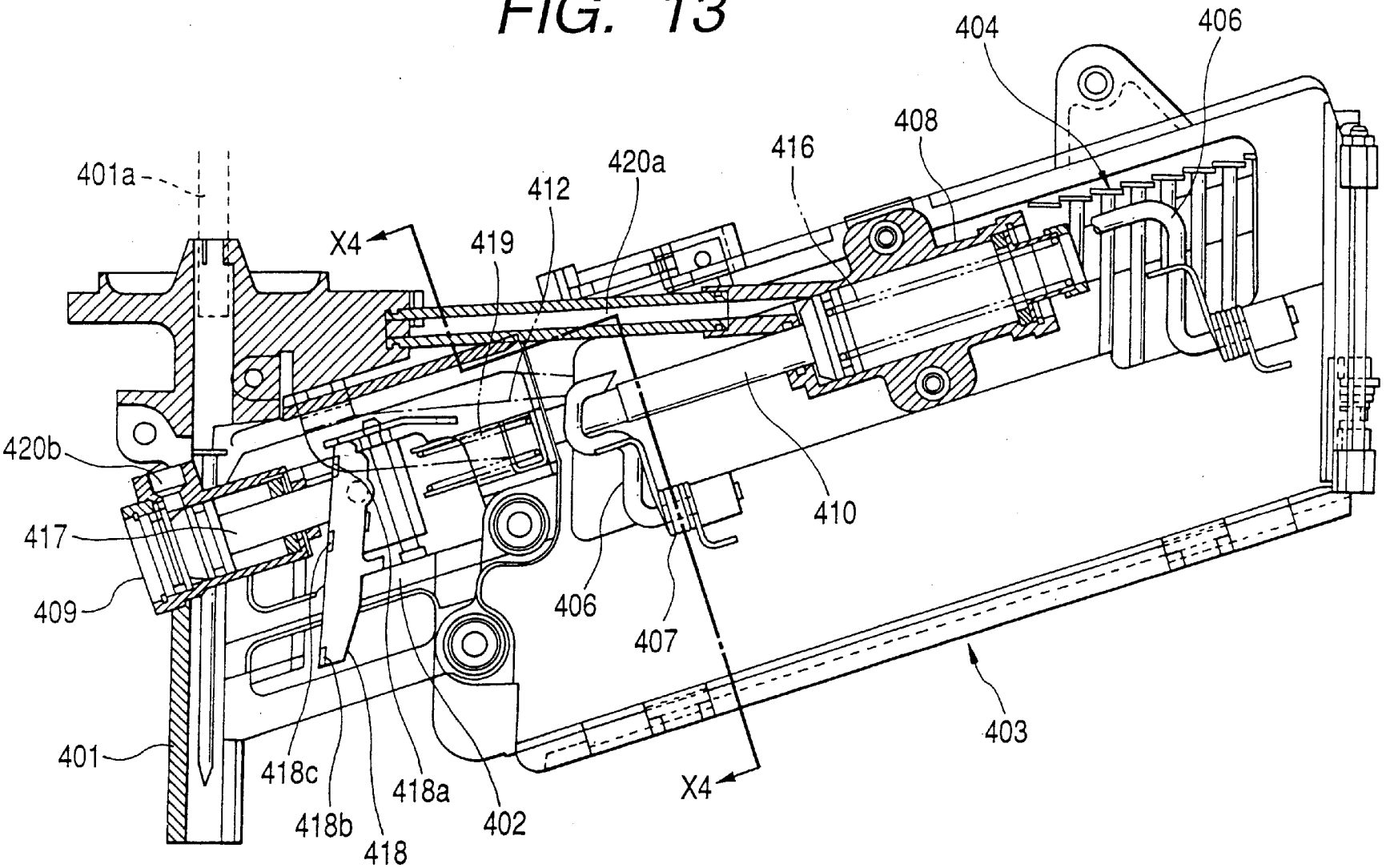
FIG. 13 is a side view showing the cross section of an essential portion of a nail feeding mechanism of a nailing machine.
Figure 14:
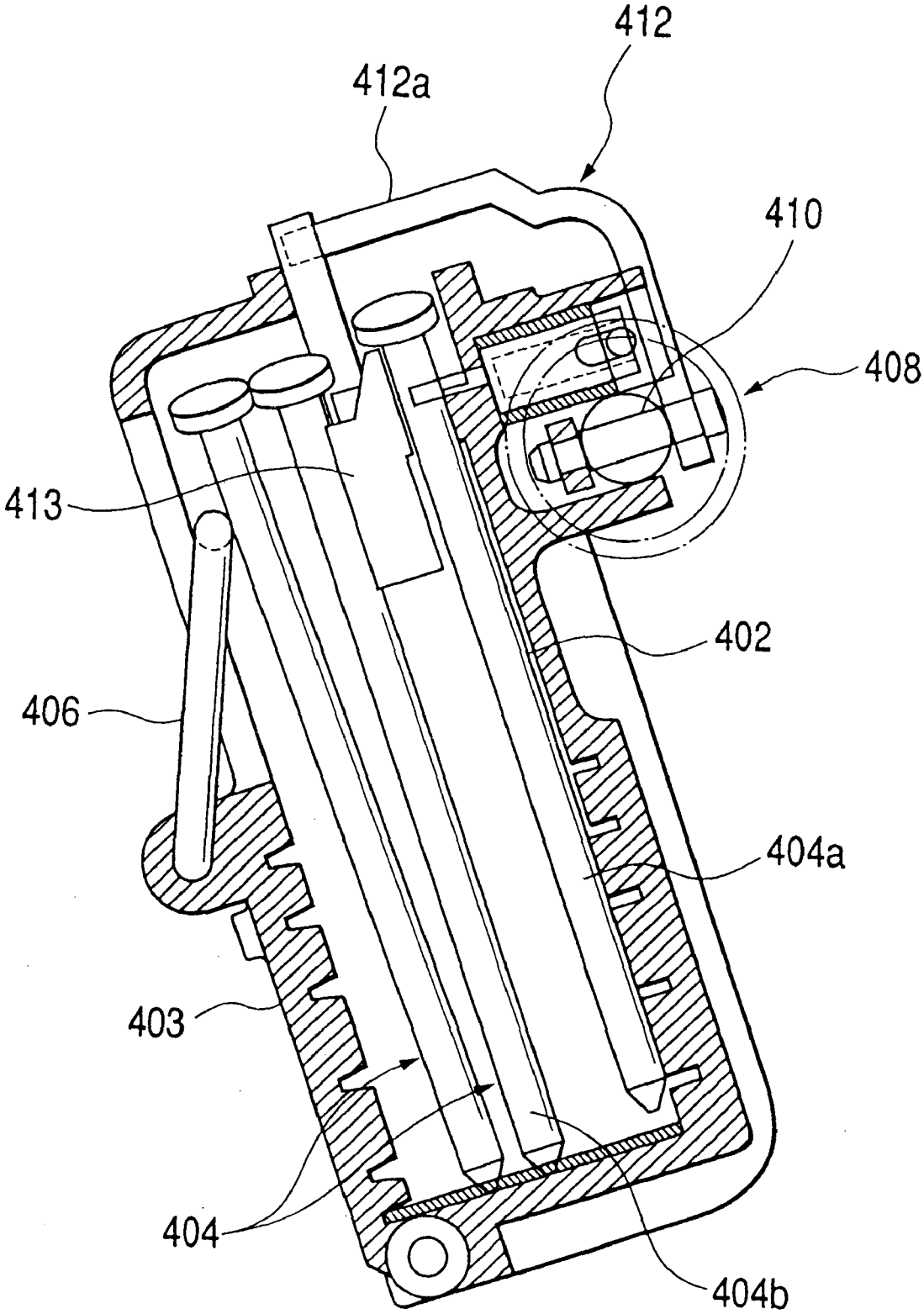
FIG. 14 is a cross sectional view taken along line X4—X4 shown in FIG. 13.
Figure 15:
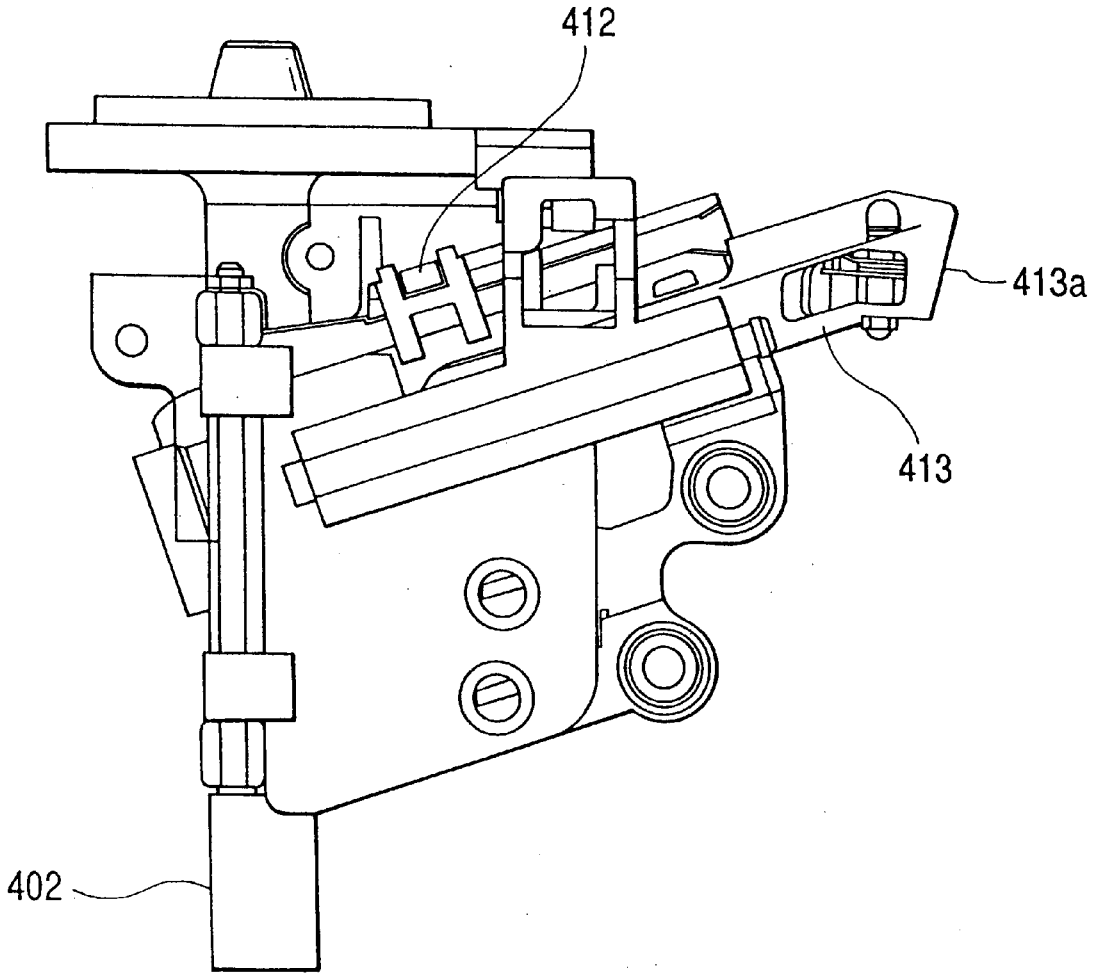
FIG. 15 is a diagram showing a state where a feeding claw and a separator of a rear feed-piston cylinder apparatus have been joined.
Figure 16A:
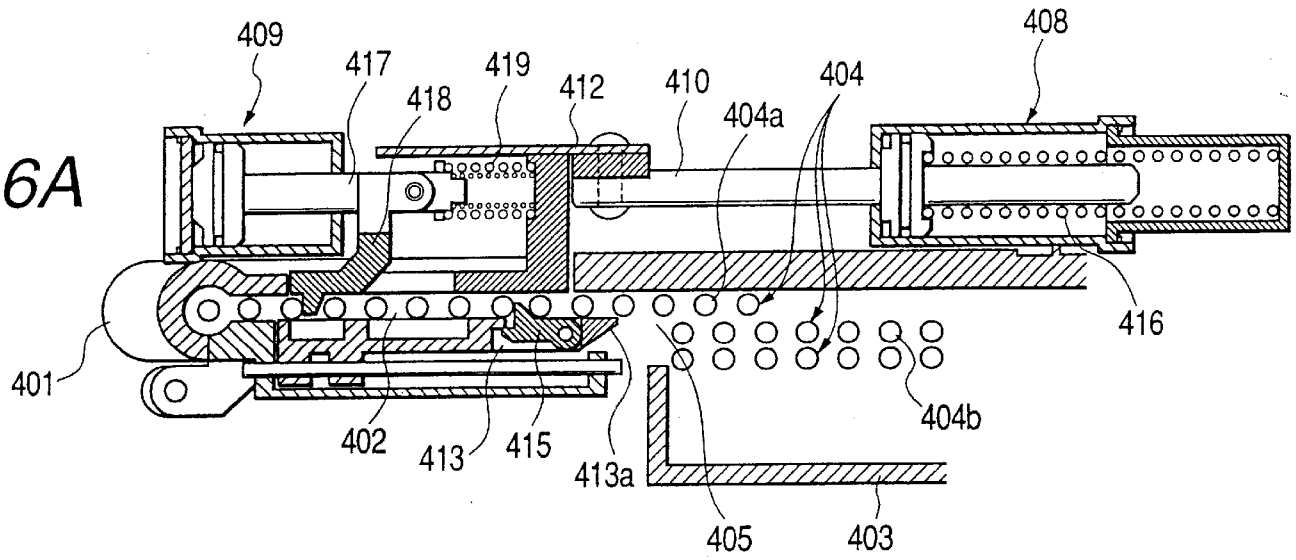
FIGS. 16A and 16B are plan views showing the operation of the nail feeding mechanism.
Figure 16B:
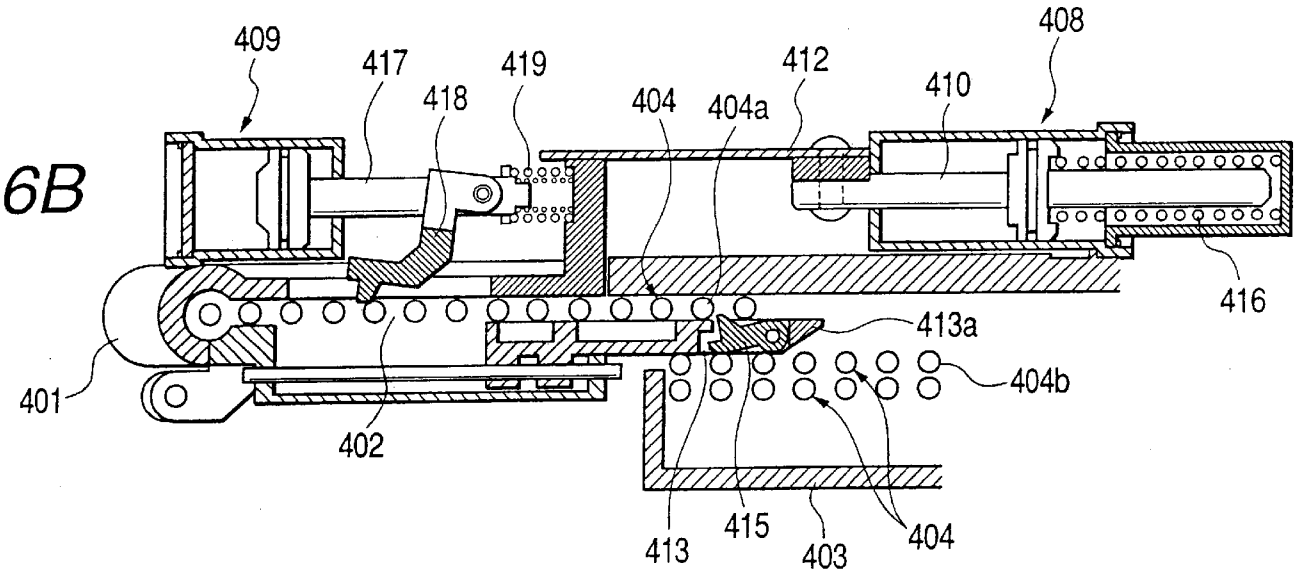

FIG. 13 is a side view showing the cross section of an essential portion of a nail feeding mechanism of a nailing machine. FIG. 14 is a cross sectional view taken along line X4—X4 shown in FIG. 13. FIG. 15 is a diagram showing a state where a feeding claw of a rear feed-piston cylinder apparatus and a separator have been joined. FIGS. 16A and 16B are plan views showing a state where the nail feeding mechanism is operated.

Referring to the drawings, reference numeral 401 represents a nose portion formed at the leading end of the body (not shown) of a nailing machine. The nose portion 401 slidably guides a driver 401*a* struck by a striking mechanism, the nose portion 401 being opened at an end of a nail feeding passage 402. The nail feeding passage 402 has a width with which one connected nail can be fed to the nose portion 401. The front end of the nail feeding passage 402 is opened in the nose portion 401, while the rear end of the same is opened in a magazine 403. The magazine 403 is a multiple-loading magazine structured to be capable of receiving a plurality of connected nails 404 which are disposed in a horizontal state. The connected nails 404 are formed by connecting a plurality of nails connected to one another in a straight line with connecting members.

A multiplicity of rows of connected nails 404 are loaded in the magazine 403. The front end of the connected nails 404*a* in the first row which is the innermost row faces a rear end opening 405 of the nail feeding passage 402. A pressing bar 406 is joined to the outer surface of the magazine 403. The pressing bar 406 incorporates a spring 407 which presses the outermost connected nails 404 to be moved inwards. Therefore, when the inner connected nails 404 have been discharged from the magazine 403, next connected nails 404 are pressed by the pressing bar 406 so as to be laterally moved to the innermost position.

A nail feeding mechanism is disposed in a region from the magazine 403 to the nail feeding passage 402 to sequentially feed the connected nails 404 starting with the innermost connected nails 404 to the nose portion 401 through the front nail feeding passage 402.

That is, feed-piston cylinder apparatuses 408 and 409 each incorporating a feed piston which reciprocates in the lengthwise direction are disposed at two positions along the nail feeding passage 402.

A separator arm 412 is joined to the front end of the feed piston rod 410 of the rear feed-piston cylinder apparatus 408. The front portion 412*a* of the separator arm 412 is bent upwards, and then bent to traverse the nail feeding passage 402 to reach the opposite portion. The separator arm 412 is joined so as to be guided and moved along a guide groove 14 formed in the upper portion of the nail feeding passage 402. A separator 413 is connected and secured to an end of the separator arm 412, the separator 413 being capable of moving into the magazine 403 and retreating from the same. A rear end 413*a* of the separator 413 is formed into a sharp edge. When the feed piston rod 410 is at the front movement end, the separator 413 is retreated to a position (a position with which the lateral movement of the connected nails 404 in the magazine 403 is not obstructed) adjacent to the front end opening 405 of the magazine 403. When the feed piston rod 410 is at the rear movement end, the separator 413 is introduced between the innermost connected nails 404*a* and next connected nails 404*b*. The separator 413 has a first feeding claw 415 urged by a spring so as to be capable of rotating to be engaged to the connected nails 404*a* in the first row and always rotated inwards. The feed-piston cylinder apparatus 408 is supplied with compressed air through an air conduit 420*a* so that the feed-piston cylinder apparatus 408 is moved to the rear end. When compressed air has been discharged, the feed-piston cylinder apparatus 408 is moved forwards owing to the spring 416. The stroke of the first feeding claw 415 is determined to a value with which a plurality of the nails can be fed at a time between the magazine 403 and the nail feeding passage 402.

The feed piston rod 417 of he front feed-piston cylinder apparatus 409 has a second feeding claw 418. The front feed-piston cylinder apparatus 409 is supplied with compressed air through an air conduit 420*b* so as to be moved to the rear end. After compressed air has been discharged, the front feed-piston cylinder apparatus 409 is moved forwards owing to the spring 419. The forward movement end of the second feeding claw 418 is determined to be a position near the nose portion 401. Moreover, the stroke of the second feeding claw 418 is determined to be a stroke substantially the same the pitch between the two nails. As shown in FIG. 13, the second feeding claw 418 has a considerable length so as to be adaptable to nails having variable length as shown in FIG. 13. The second feeding claw 418 has three engaging claws, 418*a*, 418*b* and 418*c*.

The rear feed-piston cylinder apparatus 408 and the front feed-piston cylinder apparatus 409 are operated at the same timing. The nail feeding passage 402 is provided with a stopper claw 420 to prevent inverse movement of the connected nails 404 in the rearward direction.

The rear feed-piston cylinder apparatus 408 and the front feed-piston cylinder apparatus 409 of the nail feeding mechanism are supplied with compressed air. Thus, as shown in FIG. 16B, the first feeding claw 415 and the second feeding claw 418 are moved rearwards to the movement end of the rear end so as to be engaged to the shafts of he connected nails 404*a* in the first row in the magazine 403 which is the innermost row. The separator 413 of the rear feed-piston cylinder apparatus 408 is introduced between the connected nails 404*a* and 404*b* in the first and second rows in the magazine 403 to separate the connected nails 404 in the two rows into the inner nails 404 and the outer nails 404. Thus, engagement and interference of the connected nails 404 in the different rows can be prevented. As a result, the inner connected nails 404 can smoothly and reliably be fed. After compressed air supplied to the two feed-piston cylinder apparatuses 408 and 409 has been discharged, the first and second feeding claws 415 and 418 are, together with the corresponding feed piston rods 410 and 417, moved forwards for predetermined strokes. Thus, the inner connected nails 404 are fed. When the nail feeding mechanism has been operated first after loading of the connected nails 404, a plurality of the connected nails 404 are fed at a time. When the leading end nail of the connected nails 404 has been supplied to the nose portion 401, one nail is newly fed.

When the nailing machine has been operated after supply of the nail to the nose portion 401, the driver 401*a* shown in FIG. 13 is operated so that the nail in the nose portion 401 is driven. Then, compressed air is supplied to the rear feed-piston cylinder apparatus 408 and the front feed-piston cylinder apparatus 409 so that one nail is newly fed to the nose portion 401. Then, the operation for driving the nails is sequentially and similarly performed.

After the connected nails 404 in the nail feeding passage 402 have been consumed and the rear end nail has been discharged from the magazine 403, the next connected nails 404*b* are pushed out to the innermost position by the pressing bar 406. The operation of the nail feeding mechanism causes the innermost connected nail which has newly been moved to be engaged to the rear end of the forward connected nail 404 owing to the first feeding claw 415 of the rear feed-piston cylinder apparatus 408. Therefore, the successive operation for driving the nails cannot be interrupted.

After the final connected nail 404 in the magazine 403 has been discharged, the rear end of the foregoing connected nail 404 is discharged to the outside of the movement range for the first feeding claw 415 of the rear feed-piston cylinder apparatus 408. Thus, feeding caused by the first feeding claw 415 is interrupted. The operation for feeding the foregoing connected nail 404 is continued by the second feeding claw 418 of the front rear feed-piston cylinder apparatus 409. Since the forward movement end for the second feeding claw 418 is near the nose portion 401, substantially all of the nails can be fed to the nose portion 401.

The first feeding claw 415 arranged to feed the connected nails 404 also acts to guide the connected nails 404. Therefore, when the operation for feeding the connected nail 404 caused by the first feeding claw 415 is interrupted, the first feeding claw 415 does not perform the guiding operation. Since the second feeding claw 418 has the considerable length to be capable of engaging to a nail having various length, the upper and lower engaging claws 418*a*, 418*b* and 418*c*, however, reliably guide the shaft of the connected nail 404. Therefore, ejection of the lower end of the nail from the nose portion and inclination of the shaft of the nail causing defective feeding occurring during the driving operation can be prevented. That is, the nail can reliably be fed.

During the operation of the rear feed-piston cylinder apparatus 408, the separator 413 reciprocates between the position adjacent to the front opening 405 of the magazine 403 and the inside portion of the magazine 403. When the innermost connected nails 404 are present in the magazine 403, the separator 413 is operated not to engage to the adjacent connected nails 404. When the connected nails 404*a* in the first row have been discharged from the magazine 403 and the feed piston rod 410 has been moved to the forward movement end causing the separator 413 to be discharged to the outside of the magazine 403, the next connected nails 404*b* are pushed out to the innermost position by the pressing bar 406. Then, the separator 413 is, in a manner similar to the foregoing manner, moved rearwards so as to be introduced in between the innermost connected nail fed newly and the connected nail positioned inner than the innermost connected nail. Thus, the connected nails in the different rows are separated from each other so that feeding of the innermost connected nails 404 is smoothed.

Thus, the multiplicity of the connected nails 404 loaded into the magazine 403 enable a multiplicity of nails to successively be driven.

The foregoing nail feeding mechanism incorporates the front and rear feed-piston cylinder apparatuses 408 and 409. The first feeding claw 415 of the rear feed-piston cylinder apparatus 408 feeds the connected nails 404 in the magazine 403 to the nail feeding passage 402. The second feeding claw 418 of the front rear feed-piston cylinder apparatus 409 feeds the connected nail fed by the first feeding claw 415 to the nose portion. Therefore, even if the number of final connected nails is reduced and engagement to the first feeding claw 415 is inhibited, the second feeding claw 418 enables the connected nails to reliably be fed.

Since the two feed-piston cylinder apparatuses 408 and 409 are disposed at the front and rear positions, respectively, the strokes of the feed piston rods 410 and 417 can be optimized. If necessary, the operation timing can be changed.

Now, referring to FIGS. 17–21C, the fifth embodiment of the present invention is specifically described.

Figure 17:
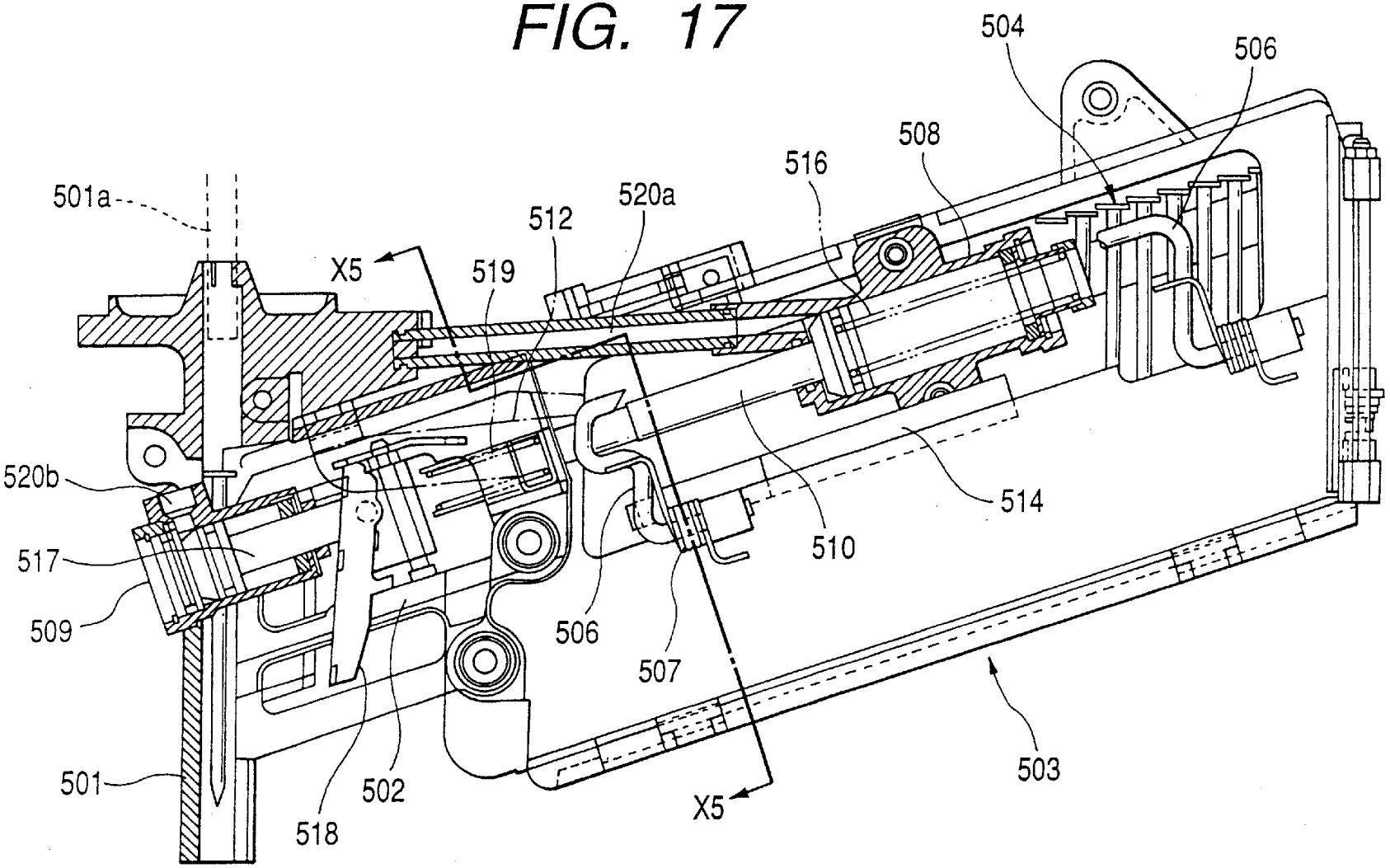
FIG. 17 is a side view showing the cross section of an essential portion of a nail feeding mechanism of a nailing machine.
Figure 18:
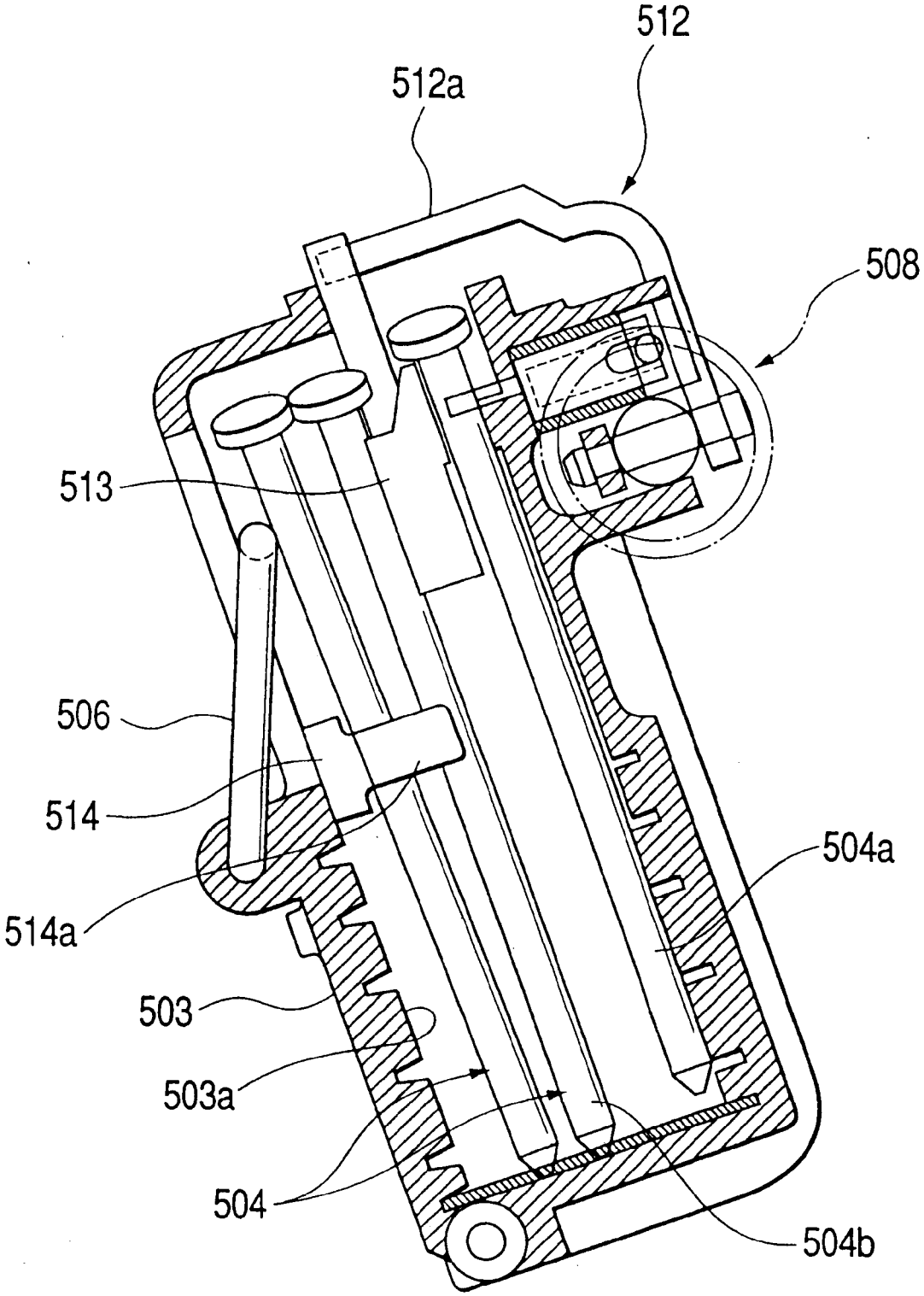
FIG. 18 is a cross sectional view taken along line X5—X5 shown in FIG. 17.
Figure 19:
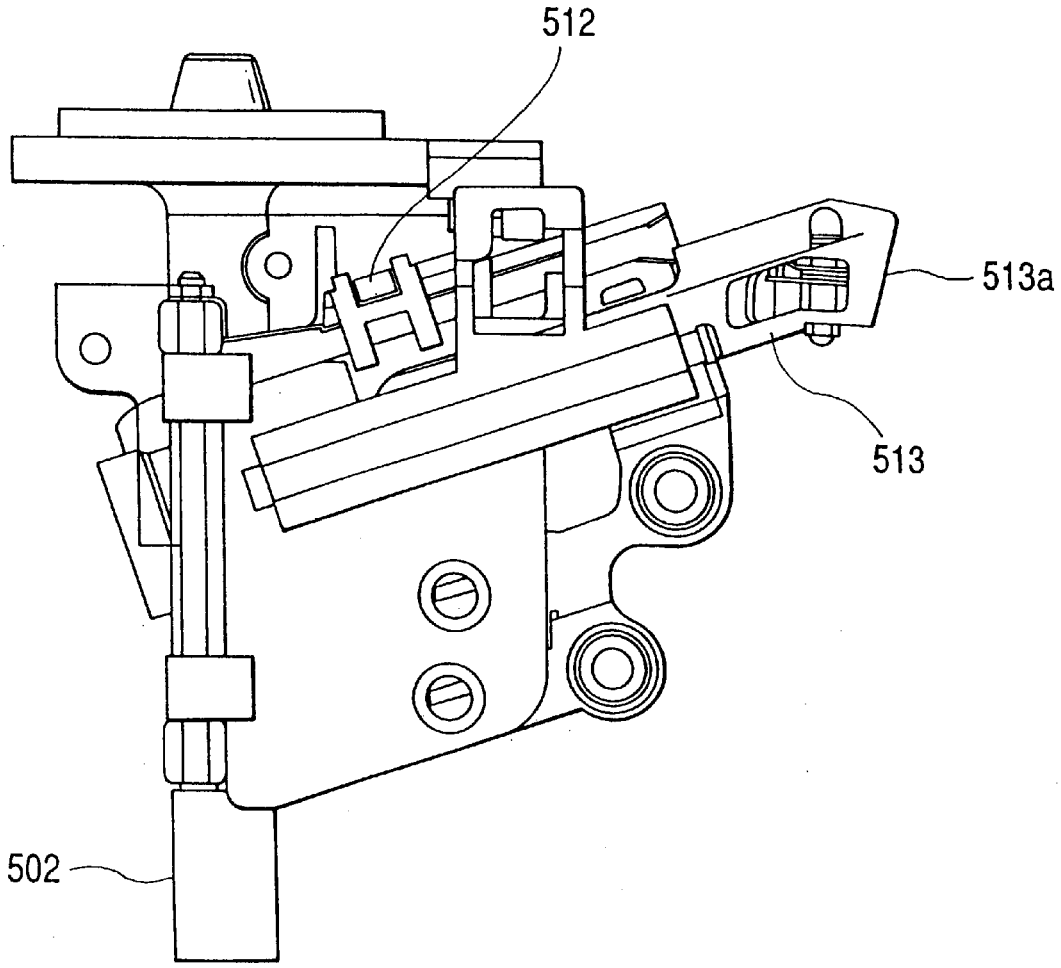
FIG. 19 is a diagram showing a state where a feeding claw and a separator of the rear feed-piston cylinder apparatus have been joined.
Figure 20A:
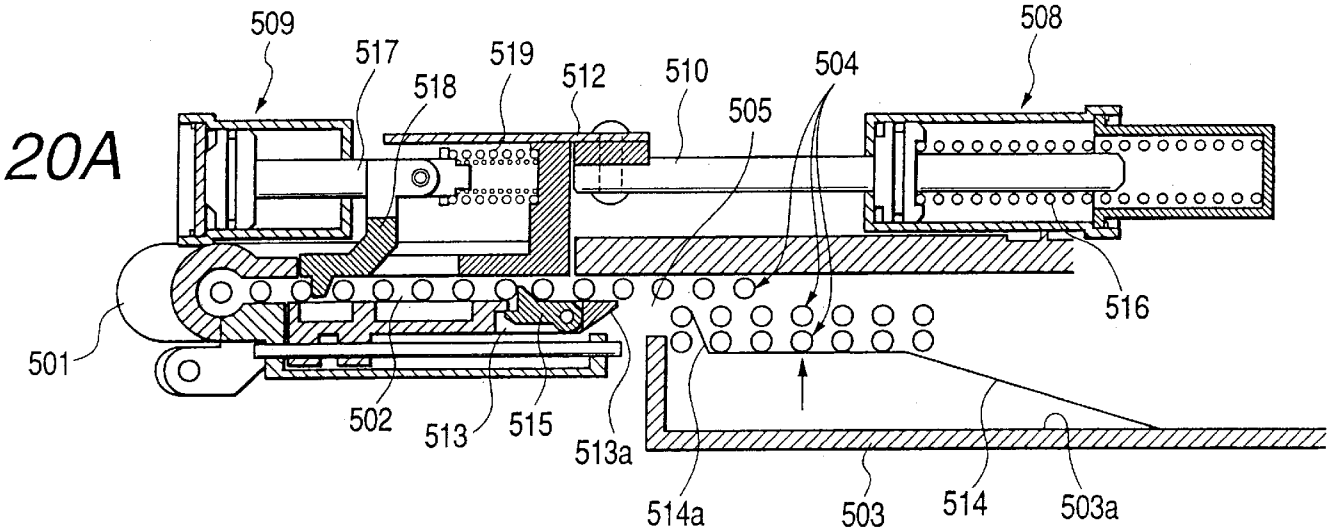
FIGS. 20A and 20B are plan views showing the operation of the nail feeding mechanism.
Figure 20B:
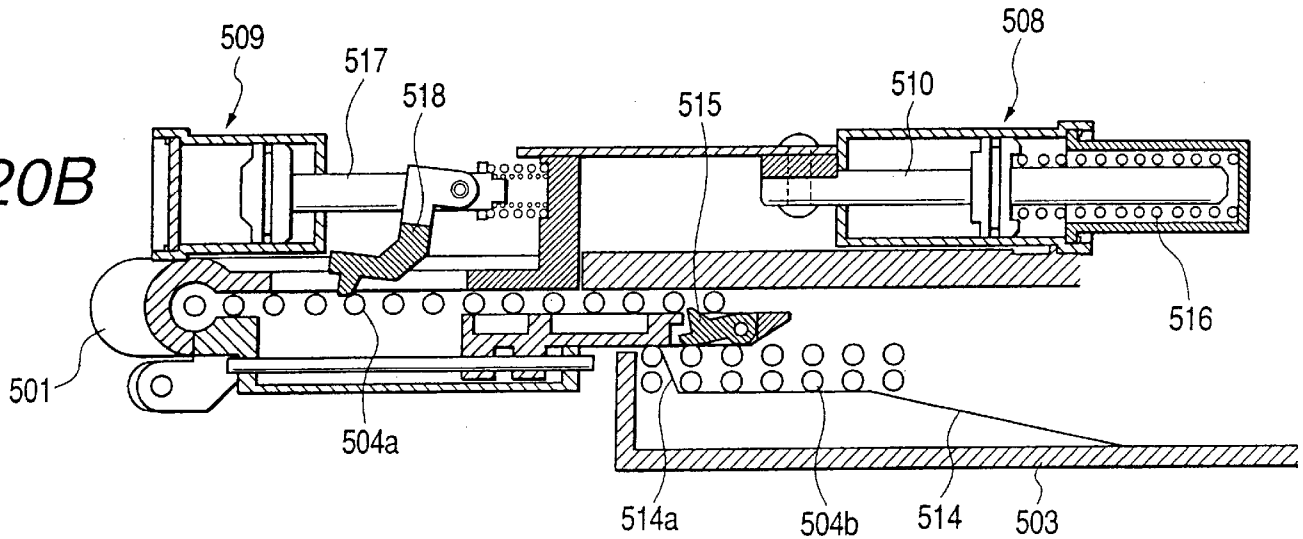

FIG. 17 is a side view showing the cross section of an essential portion of a nail feeding mechanism of a nailing machine. FIG. 18 is a cross sectional view taken along line X—X shown in FIG. 17. FIG. 19 is a diagram showing a state in which a feeding claw and a separator of a rear feed piston cylinder apparatus have been joined. FIGS. 20A and 20B are plan views showing the operation of the nail feeding mechanism.

Referring to the drawings, reference numeral 501 represents a nose portion for slidably guiding a driver 501*a* struck by a striking mechanism disposed at the leading end of the body (not shown) of a nailing machine, the nose portion 501 being opened at an end of the nail feeding passage 502. The nail feeding passage 502 has a width with which one connected nail can be fed to the nose portion 501. The front end of the nail feeding passage 502 is opened in the nose portion 501, while the rear end of the same is opened in a magazine 503. The magazine 503 is a multiple-loading magazine structured to be capable of receiving a plurality of connected nails 504 which are disposed in a horizontal state. The connected nails 504 are formed by connecting a plurality of nails connected to one another in a straight line with connecting members.

A multiplicity of rows of connected nails 504 are loaded in the magazine 503. The front end of the innermost connected nails 504*a* faces a rear end opening 505 of the nail feeding passage 502.

A pressing bar 506 is joined to the outer surface of the magazine 503. The pressing bar 506 incorporates a spring 7 which presses the outermost connected nails 504 to be moved inwards. Therefore, when the inner connected nails 504 have been discharged from the magazine 503, next connected nails 504 are pressed by the pressing bar 506 so as to be laterally moved to the innermost position.

As shown in FIG. 18, an elongated plate spring 514 is joined to an inner wall 503*a* of the magazine 503 in a direction in which the connected nails 504 are connected. The plate spring 514 is formed into a gentle Z-shape except for the front end portion thereof. The rear end of the plate spring 514 is secured to the foregoing inner wall, while the front end of the same is inwards bent so that an engaging portion 514*a* is formed.

In the foregoing structure, also the plate spring 514 is urged so as to be engaged to the shaft of the connected nails 504 in the outermost row in the magazine 503 so that the connected nails 504 are pushed out to the inside portion. Moreover, an engaging portion 514*a* is introduced between the inner connected nails 504 through the space between the connected nails 504 in the outermost row of the connected nails (the connected nails except for the connected nails in the first row) which are on standby in the magazine 503.

A nail feeding mechanism is disposed in a region from the magazine 503 to the nail feeding passage 502 to sequentially feed the connected nails 504 starting with the innermost connected nails 504 to the nose portion 501 through the front nail feeding passage 502.

That is, feed-piston cylinder apparatuses 508 and 509 each incorporating a feed piston which reciprocates in the lengthwise direction are disposed at two positions along the nail feeding passage 502.

A separator 513 (having a sharp leading end 513*a*) and a feeding claw 515 are joined to the front end of the feed piston rod 510 of the rear feed-piston cylinder apparatus 508 through a separator arm 512 which reaches the nail feeding passage 502. A second feeding claw 518 is provided for a feed piston rod 517 of the front feed-piston cylinder apparatus 509. The feed piston rods 510 and 517 of the feed-piston cylinder apparatuses 508 and 509 are supplied with compressed air through air conduits 520*a* and 520*b* so as to be moved rearwards. When compressed air has been discharged, the feed piston rods 510 and 517 are moved forwards owing to springs 516 and 519. The stroke of the first feeding claw 515 is determined to be a value with which a plurality of the nails can be fed at a time between the magazine 503 and the nail feeding passage 502. The stroke of the second feeding claw 518 is made to be substantially the same as the pitches among the nails.

The position at which the pressing bar 506 is engaged to the connected nail 504 is made to be substantially the same as the position of the separator 513. The position of the plate spring 514 is lower than the foregoing position at which the pressing bar is engaged.

When compressed air is supplied to the feed-piston cylinder apparatuses 508 and 509 of the nail feeding mechanism, the feeding claw 515 and the second feeding claw 518 are rearwards moved to the rear movement end, as shown in FIG. 20B. Thus, the feeding claws 515 and 518 are engaged to the shafts of the innermost connected nails 504*a* in the magazine 503. The separator 513 of the rear feed-piston cylinder apparatus 508 is introduced between the connected nails 504*a* and 504*b* in the first and second rows in the magazine 503 to separate the connected nails 504 in the two rows to prevent engagement and interference of the shafts of the connected nails 504 in the two rows. When compressed air supplied to the two feed-piston cylinder apparatuses 508 and 509 has been discharged, the feeding claw 515 and the second feeding claw 518 are, together with the feed piston rods 510 and 517, moved forwards by the spring force, as shown in FIG. 20A for the predetermined stroke. As a result, the inner connected nails 504 are fed so that the separator 513 is removed from the magazine 503. When the nail feeding mechanism has first been operated after the connected nails have been loaded, a plurality of the connected nails 504 are fed at a time. When the leading one of the connected nails 504 has been supplied to the nose portion 501, one nail is successively fed.

When the nailing machine has been operated after supply of the nails to the nose portion 501, the driver 501*a* shown in FIG. 17 is operated so that the nail in the nose portion 501 is driven. Then, compressed air is supplied to the rear feed-piston cylinder apparatus 508 and the front feed-piston cylinder apparatus 509 so that one nail is newly fed to the nose portion 501. After the connected nails 504 in the nail feeding passage 502 have been consumed and the rear end nail has been discharged from the magazine 503. After the removal of the separator 513 from the magazine 503, the pressing bar 506 and the spring force of the plate spring 514 push out the next connected nails 504*b* to the innermost portion. The operation of the nail feeding mechanism causes the innermost connected nails newly moved as described above to be engaged to the rear end of the forward connected nails 504 by the feeding claw 515 of the rear feed-piston cylinder apparatus 508. Thus, the multiplicity of the connected nails 504 loaded into the magazine 503 enable a multiplicity of nails to successively be driven.

Figure 21A:
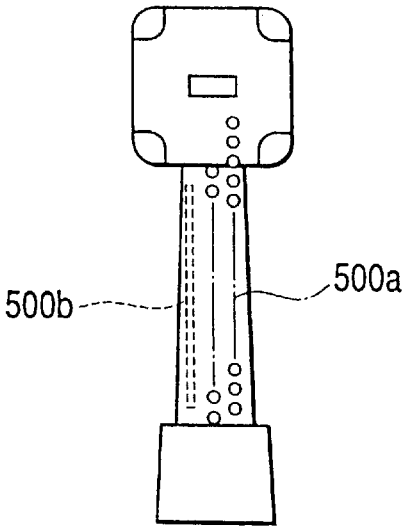
FIG. 21A is a diagram showing a downward driving state and FIGS. 21B and 21C are diagrams showing a lateral driving state.

When the nail driving operation is performed such that the lateral driving operation with which the direction in which the nailing machine drives a nail is changed as shown in FIG. 21A, the connected nails 504 in the multiple-loading magazine 503 are moved owing to their deadweight. The connected nails 504 in the first row cannot be moved downwards owing to the feeding claws 515 and 518. Since the standby connected nails 504 have been engaged to the engaging portion 514*a* of the plate spring 514, undesirable downward and sliding movement can be prevented. As a result, the connected nails 504 are not moved and maintained.

Figure 21B:
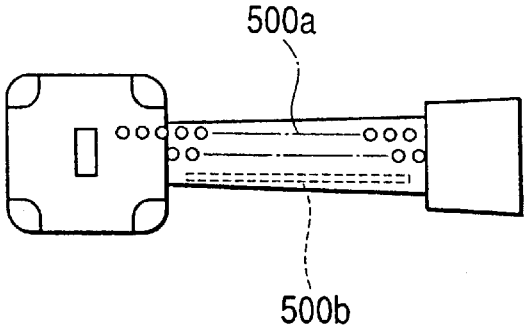
Figure 21C:
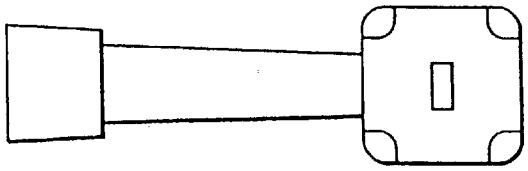

When the driving method is changed as shown in FIG. 21B, the weight of the standby connected nail 504 is exerted on the pressing bar 506. The connected nail 504 can be held owing to the pressing bar 506 or the spring force of the plate spring 514.

The connected nails 504 are not pressed to be moved inwards by only the pressing bar 506, but also the plate spring 514 presses the connected nails 504. Therefore, the force of the pressing bar 506 is not required to be enlarged considerably to obtain sufficiently large force. The pressing bar 506 is disposed at a position corresponding to the separator 513. Since the plate spring 514 is disposed at the different position, excessively high force is not exerted on the separator 513. Therefore, the smooth movement of the separator 513 is not inhibited.

If the number of the connected nails 504 on standby in the magazine 503 is reduced, also the distance of the movement of the plate spring 514 after the separator 513 has been removed is elongated. Therefore, the leading end is sometimes engaged to the connected nails 504*a* in the first row present in the nail feeding passage. When the connected nails 504*a* are moved forwards, the engaging portion 514*a* is deflected to cause the engagement with the connected nail to be suspended. Thus, the engaging portion 514*a* permits the movement of the connected nails. Therefore, movement of the connected nails in the first row is not obstructed.

While only certain embodiments of the invention have been specifically described herein, it will be apparent that numerous modifications may be made thereto without departing from the spirit and scope of the invention.

The present invention is based on Japanese Patent Application No. Hei. 11-57629, Hei. 11-57630, Hei. 11-57631, Hei. 11-144049, and Hei. 11-144050 which are incorporated herein by references.

What is claimed is:

1. A multiple-loading magazine mechanism for a nailing machine comprising:

a nail feeding passage for guiding one of plural rows of connected nails to a striking mechanism of the nailing machine, the plural rows of connected nails aligned parallel each other in a magazine;

a pressing bar in the magazine such that said pressing bar is urged to engage connected nails in an outermost row with respect to said nail feeding passage and bias said rows toward said nail feeding passage; and a plate spring disposed in the magazine and below said pressing bar, said plate spring including a bent engaging portion introduced between connected nails in the outermost row and passed between connected nails in an inner row of standby connected nails in the magazine.

* * * * *